US008589055B2

(12) United States Patent
Hakariya et al.

(10) Patent No.: US 8,589,055 B2
(45) Date of Patent: Nov. 19, 2013

(54) INTER-CYLINDER AIR/FUEL RATIO IMBALANCE DETERMINATION APPARATUS AND INTER-CYLINDER AIR/FUEL RATIO IMBALANCE DETERMINATION METHOD

(75) Inventors: Masashi Hakariya, Nagoya (JP); Masahide Okada, Kariya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 269 days.

(21) Appl. No.: 13/194,915

(22) Filed: Jul. 30, 2011

(65) Prior Publication Data

US 2012/0024274 A1 Feb. 2, 2012

(30) Foreign Application Priority Data

Jul. 30, 2010 (JP) ..... 2010-171576

(51) Int. Cl.
*F02D 17/00* (2006.01)

(52) U.S. Cl.
USPC ..... 701/112; 123/481; 123/672

(58) Field of Classification Search
USPC ..... 123/481, 672, 673, 690, 691; 701/103–105, 107, 111, 112; 73/35.06, 73/114.72
See application file for complete search history.

(56) References Cited

U.S. PATENT DOCUMENTS

| | | | | |
|---|---|---|---|---|
| 7,152,594 | B2 | 12/2006 | Anilovich et al. | |
| 8,302,581 | B2 * | 11/2012 | Nishikiori et al. | 123/434 |
| 2011/0192146 | A1 * | 8/2011 | Sugimoto et al. | 60/276 |
| 2012/0209498 | A1 * | 8/2012 | Aoki et al. | 701/103 |
| 2012/0253642 | A1 * | 10/2012 | Kitano et al. | 701/104 |

FOREIGN PATENT DOCUMENTS

| | | | | |
|---|---|---|---|---|
| JP | 4-080653 | A | 3/1992 | |
| JP | 4-204246 | A | 7/1992 | |
| JP | 6-273381 | A | 9/1994 | |
| JP | 11072473 | A | 3/1999 | |
| JP | 2000065782 | A | 3/2000 | |
| JP | 2001-074693 | A | 3/2001 | |
| JP | 2002-048761 | A | 2/2002 | |
| JP | 2004069547 | A | 3/2004 | |
| JP | 2007-017191 | A | 1/2007 | |
| JP | 2012-31774 | * | 2/2012 | F02D 45/00 |
| WO | 2007119311 | A1 | 10/2007 | |
| WO | WO 2010/087025 | * | 8/2010 | F02D 45/00 |

* cited by examiner

*Primary Examiner* — Hai Huynh
(74) *Attorney, Agent, or Firm* — Gifford, Krass, Sprinkle, Anderson & Citkowski, P.C.

(57) ABSTRACT

The invention provides an inter-cylinder air/fuel ratio imbalance determination apparatus and method. The determination apparatus includes a "limiting current type air/fuel ratio sensor", and acquires a pre-correction index quantity that is greater the greater the degree of non-uniformity of the cylinder-by-cylinder air/fuel ratios, on the basis of a time differential value of the output value of the air/fuel ratio sensor. The determination apparatus obtains as the correction-purpose output value an average value of the output value obtained during a fuel-cut operation. The correction-purpose output value is greater the higher the responsiveness of the air/fuel ratio sensor. The determination apparatus acquires an air/fuel ratio imbalance index value by correcting the pre-correction index quantity so that the pre-correction index quantity is smaller the greater the correction-purpose output value. It is determined that an inter-cylinder air/fuel ratio imbalance state has occurred, when the air/fuel ratio imbalance index value is greater than or equal to an imbalance determination threshold value.

14 Claims, 17 Drawing Sheets

INTER-CYLINDER AIR/FUEL RATIO IMBALANCE DETERMINATION APPARATUS AND INTER-CYLINDER AIR/FUEL RATIO IMBALANCE DETERMINATION METHOD

CROSS-REFERENCE TO RELATED APPLICATIONS

This application claims the priority to Japanese Patent Application No. 2010-171576 filed on Jul. 30, 2010, which is incorporated herein by reference in its entirety including the specification, drawings and abstract.

BACKGROUND OF THE INVENTION

1. Field of the Invention

The invention relates to an inter-cylinder air/fuel ratio imbalance determination apparatus and an inter-cylinder air/fuel ratio imbalance determination method.

2. Description of Related Art

An air/fuel ratio control apparatus as shown in FIG. 1 that includes a three-way catalyst 43 disposed in an exhaust passageway of a multi-cylinder internal combustion engine 10, and an upstream-side air/fuel ratio sensor 56 disposed upstream of the three-way catalyst 43 has been widely known.

This air/fuel ratio control apparatus calculates an air/fuel ratio feedback amount (main feedback amount) on the basis of the output value of the upstream-side air/fuel sensor 56 and performs a feedback control of the air/fuel ratio of an engine 10 by the feedback amount so that the air/fuel ratio of a mixture supplied into the engine 10 (the air/fuel ratio of the engine and, therefore, the air/fuel ratio of exhaust gas) becomes equal to a target air/fuel ratio. This feedback amount is a control amount that is common to all the cylinders. The target air/fuel ratio is set at a predetermined reference air/fuel ratio within a window of the three-way catalyst 43. The reference air/fuel ratio is generally the stoichiometric air/fuel ratio. The reference air/fuel ratio can be altered to a value in the vicinity of the stoichiometric air/fuel ratio according to the amount of air taken into the engine and the degree of degradation of the three-way catalyst 43.

Incidentally, the air/fuel ratio control apparatus as described above is generally applied to an internal combustion engine that adopts an electronically controlled fuel injection apparatus. In such an internal combustion engine, at least one fuel injection valve 33 is provided for each cylinder of each of the intake ports that communicate with the cylinders. Therefore, if the characteristic of the fuel injection valve of a specific cylinder becomes a "characteristic of injecting an excessive amount of fuel that is greater than a commanded amount of fuel injection (commanded fuel injection amount)", only the air/fuel ratio of mixture supplied to that specific cylinder (the air/fuel ratio of that specific cylinder) changes to the rich side. That is, the non-uniformity in the air/fuel ratio among the cylinders (variations in the air/fuel ratio among the cylinders, the inter-cylinder imbalance proportion regarding the air/fuel ratio) becomes large. In other words, there occurs conspicuous imbalance among the "cylinder-by-cylinder air/fuel ratios" that are the air/fuel ratios of the mixture supplied into the individual cylinders, and the degree of non-uniformity of the cylinder-by-cylinder air/fuel ratios becomes large.

Incidentally, in the following description, the cylinder that corresponds to a "fuel injection valve that has a characteristic of injecting an amount of fuel that is excessively larger or excessively smaller than the commanded fuel injection amount" is also referred to as "imbalance cylinder", and the other cylinders (the cylinders that correspond to the fuel injection valves that inject the commanded fuel injection amount of fuel") are also referred to as "none-imbalance cylinder (or normal cylinders)".

If the characteristic of the fuel injection valve of a specific cylinder becomes a characteristic of injecting an amount of fuel that is excessively larger than the commanded fuel injection amount", the average of the air/fuel ratios of the mixture supplied into the engine as a whole becomes an air/fuel ratio on the rich side of the target air/fuel ratio that is set at the reference air/fuel ratio. Therefore, due to the feedback amount of the air/fuel ratio that is common to all the cylinders, the air/fuel ratio of the aforementioned specific cylinder is changed to the lean side so as to approach the reference air/fuel ratio, and simultaneously, the air/fuel ratio of the other cylinders is changed to the lean side so as to move away from the reference air/fuel ratio. As a result, the average of the air/fuel ratios of mixture supplied to the engine as a whole (the average air/fuel ratio of exhaust gas) equals an air/fuel ratio in the vicinity of the reference air/fuel ratio.

However, the air/fuel ratio of the aforementioned specific cylinder is still an air/fuel ratio on the rich side of the reference air/fuel ratio, and the air/fuel ratio of the other cylinders is an air/fuel ratio on the lean side of the reference air/fuel ratio. As a result, the amount of emission discharged from each cylinder (the amount of unburned material and/or the amount of nitrogen oxides) increases, in comparison with the case where the air/fuel ratio of each cylinder is equal to the reference air/fuel ratio. Therefore, even if the average of the air/fuel ratios of mixture supplied to the engine as a whole is equal to the reference air/fuel ratio, the increased amount of emission cannot be purified by the three-way catalyst, so that a possibility of deterioration of the emission arises.

Hence, in order to avoid deterioration of the emission, it is important to detect excessively large non-uniformity in the air/fuel ratio among the cylinders (excessively large non-uniformity in the air/fuel ratio among the cylinders, that is, occurrence of the inter-cylinder air/fuel ratio imbalance state) and take some countermeasures. Incidentally, the inter-cylinder air/fuel ratio imbalance also occurs in, among others, the case where the characteristic of the fuel injection valve of a specific cylinder has become a "characteristic of injecting an amount of fuel that is excessively smaller than the commanded fuel injection amount".

A related-art inter-cylinder air/fuel ratio imbalance determination apparatus acquires a value of the locus length of an output value (output signal) of an electromotive force type oxygen concentration sensor disposed upstream of the three-way catalyst 43 as an "air/fuel ratio imbalance index value (imbalance determination-purpose parameter)". Furthermore, this determination apparatus compares the locus length and a "reference value that changes according to the engine rotation speed" and, on the basis of a result of comparison, determines whether or not the inter-cylinder air/fuel ratio imbalance state has occurred (see, e.g., U.S. Pat. No. 7,152,594). The determination as to whether or not the inter-cylinder air/fuel ratio imbalance state has occurred is also referred to simply as "imbalance determination".

The air/fuel ratio imbalance index value that makes it possible to determine whether or not the inter-cylinder air/fuel ratio imbalance state is occurring by comparing the index value with the imbalance determination threshold value is a parameter that increases with increases in "the degree of non-uniformity in the cylinder-by-cylinder air/fuel ratio between a plurality of cylinders (degree of non-uniformity of the cylinder-by-cylinder air/fuel ratios).

On the other hand, one of the related-art air/fuel ratio control apparatuses adopts a so-called "limiting current type air/fuel ratio sensor" as the upstream-side air/fuel ratio sensor 56. In this construction, the air/fuel ratio imbalance index value is acquired as an air/fuel ratio fluctuation index quantity that becomes greater the greater the fluctuation of the output value of the upstream-side air/fuel ratio sensor. This is because if the degree of non-uniformity of the cylinder-by-cylinder air/fuel ratios becomes great, the exhaust gases from imbalance cylinders and the exhaust gas from the non-imbalance cylinders are sequentially discharged, so that the greater the degree of non-uniformity of the cylinder-by-cylinder air/fuel ratios becomes, the greater the fluctuation of the air/fuel ratio of exhaust gas becomes. Incidentally, in the foregoing description, the limiting current type air/fuel ratio sensor is also referred to simply as "air/fuel ratio sensor".

The air/fuel ratio fluctuation index quantity can be acquired on the basis of "various basic index quantities calculated on the basis of the output value of the air/fuel sensor" as described below. Representative examples of the basic index quantities include time-regarding "differential values (a time differential value, that is, a slope), and the second-order differential value, etc., such as "an output value of the air/fuel ratio, a high-pass filter-processed output value obtained through the high-pass filter processing of the output value of the air/fuel sensor, and the air/fuel ratio represented by the output value of the air/fuel ratio (upstream-side air/fuel ratio)", etc.

However, the response of the limiting current type air/fuel ratio sensor (the change in the output value of the air/fuel sensor relative to the change in the air/fuel ratio of exhaust gas to be detected) differs among individual air/fuel sensors. That is, the air/fuel ratio sensors have individual product differences. Therefore, in the case where the degree of non-uniformity in the cylinder-by-cylinder air/fuel ratio is "a specific value", the output value of a high-response air/fuel ratio sensor fluctuates as shown in FIG. 10A, and the output value of an air/fuel ratio sensor that has a responsiveness equal to a center of the tolerance fluctuates as shown in FIG. 10B, and the output value of a low-response air/fuel ratio sensor fluctuates as shown in FIG. 10C. That is, even if the degree of non-uniformity of the cylinder-by-cylinder air/fuel ratios is a "specific value", the manner of the fluctuation of the output value of an air/fuel ratio sensor varies depending on the responsiveness of the air/fuel ratio. Therefore, even if the air/fuel ratio fluctuation index quantity is fixed at a "certain value", there occurs a case where the degree of non-uniformity of the cylinder-by-cylinder air/fuel ratios varies. As a result, if the imbalance determination is executed on the basis of comparison between the air/fuel ratio imbalance index value obtained on the basis of the air/fuel ratio fluctuation index quantity and the imbalance determination threshold value, there is a possibility of false determination.

SUMMARY OF THE INVENTION

The invention has been accomplished in order to cope with the aforementioned problems. That is, the invention provides an inter-cylinder air/fuel ratio imbalance determination apparatus and an inter-cylinder air/fuel ratio imbalance determination method that are capable of accurately carrying out imbalance determination by acquiring an "air/fuel ratio imbalance index value that accurately represents the degree of non-uniformity of cylinder-by-cylinder air/fuel ratios on the basis of output values of an air/fuel ratio sensor, regardless of the responsiveness of the air/fuel ratio sensor.

An inter-cylinder air/fuel ratio imbalance determination apparatus according to one aspect of the invention (hereinafter, also referred to as "apparatus of the invention") includes a limiting current type air/fuel ratio sensor, a plurality of fuel injection valves, an injection command signal send-out device, a fuel-cut device, an air/fuel ratio imbalance index value acquisition device, and an imbalance determination device.

The limiting current type sensor is disposed in an exhaust confluence portion of an exhaust passageway of a multi-cylinder internal combustion engine in which flows of exhaust gas discharged from a plurality of cylinders of the engine meet, or is disposed downstream of the exhaust confluence portion.

The plurality of fuel injection valves inject a fuel that is contained in a mixture that is supplied into a combustion chamber of each of the cylinders.

The injection command signal send-out device is configured to send out an injection command signal to the fuel injection valves so that each of the fuel injection valves injects an amount of the fuel that is commensurate with a predetermined commanded fuel injection amount. The predetermined commanded fuel injection amount can be determined, for example, by "feedback-correcting, on the basis of at least the output value of the air/fuel ratio sensor", the "amount of fuel injected from each fuel injection valve" so that the air/fuel ratio of exhaust gas that flows into a "three-way catalyst disposed in the exhaust passageway downstream of the air/fuel ratio sensor" equals a target air/fuel ratio.

The fuel-cut device is configured to execute a fuel-cut operation by stopping fuel injection performed by the fuel injection valves when a predetermined fuel-cut condition is satisfied.

The air/fuel ratio imbalance index value acquisition device is configured to acquire an air/fuel ratio imbalance index value that increases with increase in degree of non-uniformity between the cylinders in a cylinder-by-cylinder air/fuel ratio that is an air/fuel ratio of the mixture supplied into the combustion chamber of each of the cylinders.

The imbalance determination device is configured to determine whether or not an inter-cylinder air/fuel ratio imbalance state has occurred, based on a result of comparison between the air/fuel ratio imbalance index value acquired and a predetermined imbalance determination threshold value.

Furthermore, the air/fuel ratio imbalance index value acquisition device is configured to acquire a correction-purpose output value that increases with increase in output value of the air/fuel ratio sensor during a period of execution of the fuel-cut operation.

As described below, the output value of the air/fuel ratio sensor during the fuel-cut operation has a strong correlation with the responsiveness of the air/fuel ratio sensor. That is, the greater the output value of the air/fuel ratio sensor during the fuel-cut operation, the higher the responsiveness of the air/fuel ratio sensor. Therefore, the apparatus of the invention acquires the correction-purpose output value that is greater the greater the output value of the air/fuel ratio sensor during the fuel-cut operation, on the basis of the output value of the air/fuel ratio sensor obtained during the fuel-cut operation. Therefore, even when the degree of non-uniformity of the cylinder-by-cylinder air/fuel ratios is "a specific value", the "air/fuel ratio fluctuation index quantity that is acquired on the basis of the output value of the air/fuel ratio sensor so as to be greater the greater the fluctuation of the output value of the air/fuel ratio sensor" when the correction-purpose output value is a first value is greater than the "air/fuel ratio fluctuation index quantity that is acquired on the basis of the output value of the air/fuel ratio sensor so as to be greater the greater the fluctuation of the output value of the air/fuel ratio sensor" when the correction-purpose output value is a "second value that is smaller than the first value".

Therefore, the air/fuel ratio imbalance index value acquisition device in the apparatus of the invention is configured to acquire as the air/fuel ratio imbalance index value an "air/fuel ratio fluctuation index quantity that increases with increase in fluctuation of the output value of the air/fuel ratio sensor and that decreases with increase in the correction-purpose output value", based on the output value of the air/fuel ratio sensor and the correction-purpose output value.

Besides, according to another aspect of the invention, there is provided an inter-cylinder air/fuel ratio imbalance determination method of determining presence or absence of an inter-cylinder air/fuel ratio imbalance in an inter-cylinder air/fuel ratio imbalance determination apparatus that has: a limiting current type air/fuel ratio sensor that is disposed in an exhaust confluence portion of an exhaust passageway of a multi-cylinder internal combustion engine in which flows of exhaust gas from a plurality of cylinders of the engine meet, or is disposed downstream of the exhaust confluence portion; and a plurality of fuel injection valves that inject a fuel that is contained in a mixture supplied into a combustion chamber of each of the cylinders. This inter-cylinder air/fuel ratio imbalance determination method includes the following steps of:

sending out an injection command signal to the fuel injection valves so that each of the fuel injection valves injects an amount of the fuel that is commensurate with a predetermined commanded fuel injection amount;

executing a fuel-cut operation by stopping fuel injection performed by the fuel injection valves when a predetermined fuel-cut condition is satisfied;

acquiring an air/fuel ratio imbalance index value that increases with increase in degree of non-uniformity between the cylinders in a cylinder-by-cylinder air/fuel ratio that is an air/fuel ratio of the mixture supplied into the combustion chamber of each of the cylinders;

determining whether or not the inter-cylinder air/fuel ratio imbalance state has occurred, based on a result of comparison between the air/fuel ratio imbalance index value acquired and a predetermined imbalance determination threshold value, wherein in the step of acquiring the air/fuel ratio imbalance index value acquisition, a correction-purpose output value that increases with increase in output value of the air/fuel ratio sensor during a period of execution of the fuel-cut operation is acquired, and an air/fuel ratio fluctuation index quantity that increases with increase in fluctuation of the output value of the air/fuel ratio sensor and that decreases with increase in the correction-purpose output value is acquired as the air/fuel ratio imbalance index value, based on the output value of the air/fuel ratio sensor and the correction-purpose output value.

According to the inter-cylinder air/fuel ratio imbalance determination apparatus and the inter-cylinder air/fuel ratio imbalance determination method described above, the air/fuel ratio fluctuation index quantity that is thereby acquired is an air/fuel ratio fluctuation index quantity that is acquired without depending on the responsiveness of the actual air/fuel ratio sensor, when the responsiveness of the air/fuel ratio sensor is a "specific value (e.g., a middle value of the tolerance)". Therefore, the air/fuel ratio fluctuation index quantity (i.e., the air/fuel ratio imbalance index value) accurately represents the degree of non-uniformity of the cylinder-by-cylinder air/fuel ratios, so that the imbalance determination can be accurately performed.

Besides, the air/fuel ratio imbalance index value acquisition device may acquire a pre-correction index quantity that serves as a basis for the air/fuel ratio fluctuation index quantity, based on the output value of the air/fuel ratio sensor, and may acquire the air/fuel ratio fluctuation index quantity by correcting the pre-correction index quantity based on the correction-purpose output value so that the pre-correction index quantity decreases with increase in the correction-purpose output value.

According to this construction, firstly the pre-correction index quantity that serves as a basis for the air/fuel ratio fluctuation index quantity is obtained on the basis of the output value of the air/fuel ratio sensor, and then the pre-correction index quantity is corrected on the basis of the correction-purpose output value (i.e., a value that is greater the higher the responsiveness of the air/fuel ratio sensor) so as to be smaller the greater the correction-purpose output value. Then, the corrected value (air/fuel ratio fluctuation index quantity) is adopted as an air/fuel ratio imbalance index value, and is compared with the imbalance determination threshold value. As a result, the air/fuel ratio imbalance index value accurately represents the degree of non-uniformity of the cylinder-by-cylinder air/fuel ratios without depending on the responsiveness of the air/fuel ratio sensor, so that the imbalance determination can be accurately carried out.

Furthermore, in the apparatus of the invention, the air/fuel ratio imbalance index value acquisition device may acquire an element's temperature correlation value that increases with increase in element's temperature of the air/fuel ratio sensor occurring when the correction-purpose output value is acquired, and may correct the correction-purpose output value based on the element's temperature correlation value so that the correction-purpose output value increases with increase in the element's temperature correlation value, and may correct the pre-correction index quantity based on the correction-purpose output value corrected.

The responsiveness of the air/fuel ratio sensor is better the higher the element's temperature of the air/fuel ratio sensor. On another hand, the output value of the air/fuel ratio sensor during the fuel-cut operation is smaller the higher the element's temperature as described below (see the expression (1) shown below). Therefore, it is desirable that when the element's temperature occurring at the time of acquisition of the correction-purpose output value is high, the "correction-purpose output value that is greater the higher the responsiveness of the air/fuel ratio sensor" be made greater than when the element's temperature is low.

Hence, according to the above-described construction, the correction-purpose output value corrected by the element's temperature correlation value is a value that shows the responsiveness of the air/fuel ratio sensor, regardless of the element's temperature of the air/fuel ratio sensor occurring when the correction-purpose output value is acquired. As a result, the air/fuel ratio imbalance index value that is a value obtained by correcting the pre-correction index quantity by the correction-purpose output value is a value that even more accurately shows the degree of non-uniformity of the cylinder-by-cylinder air/fuel ratios without depending on the element's temperature of the air/fuel ratio sensor occurring when the correction-purpose output value is acquired. Therefore, the imbalance determination can be accurately carried out.

Besides, the air/fuel ratio fluctuation index quantity (air/fuel ratio imbalance index value) may be acquired by correcting the pre-correction index quantity on the basis of the element's temperature correlation value so that the pre-correction index quantity is greater the greater the element's temperature correlation value.

This also causes the air/fuel ratio imbalance index value to be a value that even more accurately shows the degree of non-uniformity of the cylinder-by-cylinder air/fuel ratios without depending on the element's temperature of the air/fuel ratio sensor occurring when the correction-purpose output value is acquired, and therefore makes it possible to more accurately carry out the imbalance determination.

Besides, in the apparatus of the invention, the air/fuel ratio imbalance index value acquisition device may acquire a post-responsiveness-correction sensor output value by correcting the output value of the air/fuel ratio sensor based on the correction-purpose output value so that the output value of the air/fuel ratio sensor decreases with increase in the correction-purpose output value, and may acquire the air/fuel ratio fluctuation index quantity based on the post-responsiveness-correction sensor output value.

According to this construction, the output value of the air/fuel ratio sensor is corrected so as to be smaller the greater the "correction-purpose output value that is greater the higher the responsiveness". In other words, the corrected output value of the air/fuel ratio sensor is a value that has been compensated in terms of the responsiveness of the air/fuel ratio sensor (a value that has been normalized when the responsiveness is a specific value). Therefore, the air/fuel ratio fluctuation index quantity acquired on the basis of the corrected output value of the air/fuel ratio sensor is a value that accurately shows the degree of non-uniformity of the cylinder-by-cylinder air/fuel ratios without depending on the responsiveness of the air/fuel ratio sensor. As a result, the imbalance determination can be accurately carried out.

By the way, the output value of the air/fuel ratio sensor changes affected by the atmospheric pressure, as described below. The atmospheric pressure changes with altitude. Therefore, in the case where the altitude of a "vehicle in which the engine is mounted" when the correction-purpose output value is obtained and the altitude of the vehicle when the air/fuel ratio fluctuation index quantity is acquired on the basis of "the correction-purpose output value and the output value of the air/fuel ratio sensor" in order to perform the imbalance determination are greatly different from each other, it is highly likely that the correction-purpose output value is not a value of good accuracy in terms of acquisition of the air/fuel ratio fluctuation index quantity.

Therefore, the imbalance determination device may avoid executing determination as to whether or not the inter-cylinder air/fuel ratio imbalance state has occurred, if travel distance of the vehicle from a time point of acquisition of the correction-purpose output value is greater than or equal to a threshold travel distance.

If the travel distance of the vehicle is greater than or equal to the threshold value travel distance, it is highly likely that the altitude of the vehicle has greatly changed. Hence, according to the above-described construction, there does not occur "implementation of the imbalance determination based on the air/fuel ratio imbalance index value that is acquired by using an inappropriate correction-purpose output value", so that occurrence of a false determination can be avoided.

Furthermore, the imbalance determination device may avoid executing calculation of the air/fuel ratio imbalance index value, if travel distance of the vehicle from a time point of acquisition of the correction-purpose output value is greater than or equal to a threshold travel distance.

According to this construction, there does not occur "acquisition of the air/fuel ratio imbalance index value based on an inappropriate correction-purpose output value", so that implementation of a false imbalance determination can be avoided.

Other objects and other features of the apparatus of the invention as well as advantages thereof will be easily understood from the description of embodiments of the apparatus of the invention given below with reference to the drawings.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, inter-cylinder air/fuel ratio imbalance determination apparatuses (hereinafter, also referred to simply as "determination apparatuses") for internal combustion engines in accordance with various embodiments of the invention will be described with reference to the drawings. Each of these determination apparatus is a portion of an air/fuel ratio control apparatus that controls the air/fuel ratio of mixture supplied to an internal combustion engine (the air/fuel ratio of the engine), and is also a portion of a fuel injection amount control apparatus.

Figure 1:
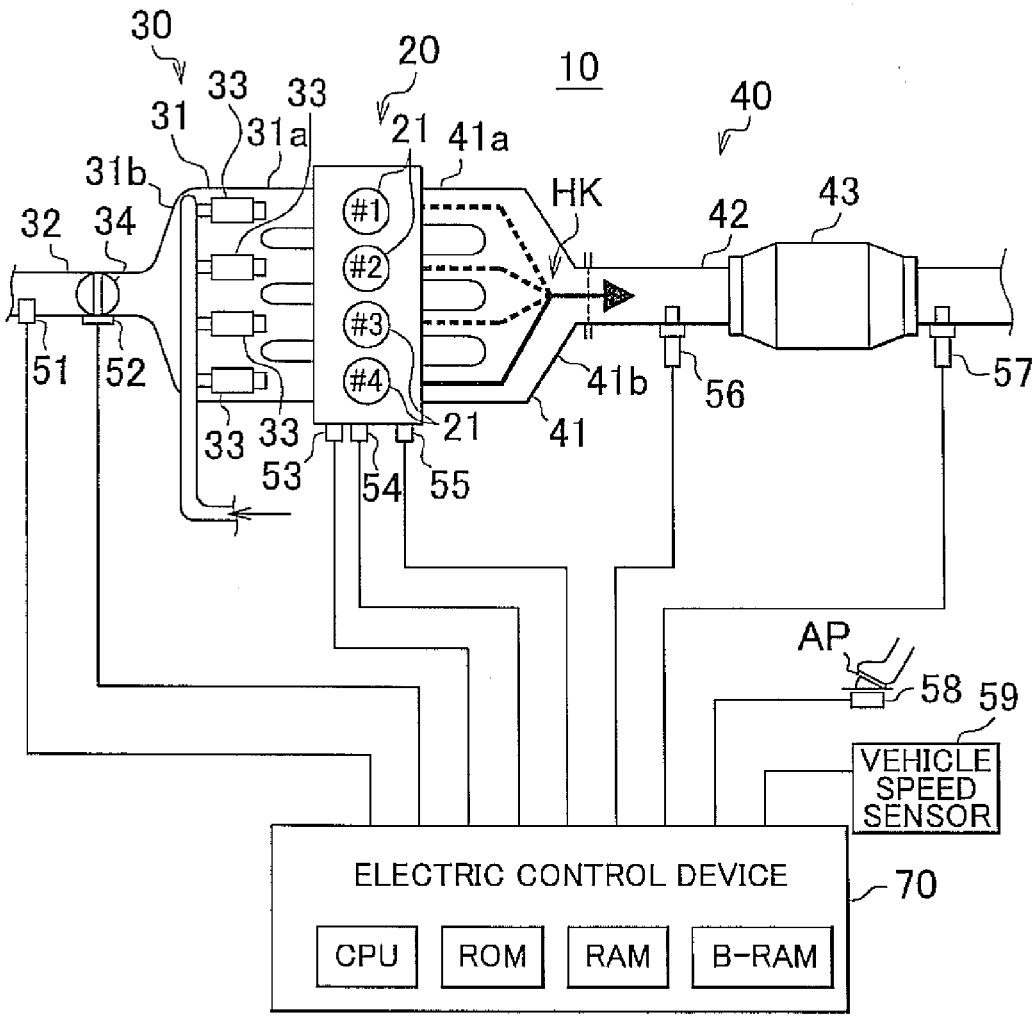
FIG. 1 is a schematic diagram of an internal combustion engine to which an inter-cylinder air/fuel ratio imbalance determination apparatus in accordance with embodiments of the invention is applied.

A first embodiment of the invention will be described. FIG. 1 shows a general construction of a system to which an inter-cylinder air/fuel ratio imbalance determination apparatus in accordance with a first embodiment of the invention (hereinafter, also referred to as "first-embodiment determination apparatus") is applied to a four-stroke, spark ignition type multi-cylinder (in-line four-cylinder) internal combustion engine 10. The engine 10 is mounted in a vehicle (not shown).

The internal combustion engine 10 includes an engine body portion 20, an intake system 30, and an exhaust system 40. The engine body portion 20 includes a cylinder block portion and a cylinder head portion. The engine body portion 20 is equipped with a plurality of cylinders (combustion chambers) 21. The cylinders communicate with "input ports and exhaust ports" (not shown). Communicating portions between the intake ports and the combustion chambers 21 are opened and closed by intake valves (not shown). Communicating portions between the exhaust ports and the combustion chambers 21 are opened and closed by exhaust valves (not shown). Each combustion chamber 21 is provided with an ignition plug (not shown).

The intake system 30 includes an intake manifold 31, an intake pipe 32, a plurality of injection valves 33, and a throttle valve 34.

The intake manifold 31 includes a plurality of branch portions 31*a* and a surge tank 31*b*. An end of each of the branch portions 31*a* is connected to a corresponding one of a plurality of intake ports. Another end of each branch portion 31*a* is connected to the surge tank 31*b*.

An end of the intake pipe 32 is connected to the surge tank 31*b*. Another end of the intake pipe 32 is provided with an air filter (not shown).

The fuel injection valves 33 are provided, one for each cylinder (combustion chamber) 21. The fuel injection valves 33 are provided in the intake ports. That is, each of the cylinders is equipped with a fuel injection valve 33 that supplies fuel independently of the other cylinders. The fuel injection valves 33, in response to a fuel injection command signal, injects "fuel in an amount equal to a commanded fuel injection amount that is contained in the injection command signal" into the intake ports (therefore, into the cylinders that correspond to the fuel injection valves 33), if the fuel injection valves 33 are normal.

More concretely, the fuel injection valve 33 opens only for a time that is commensurate with the commanded fuel injection amount. The pressure of the fuel supplied to the fuel injection valves is controlled by a pressure regulator (not shown) so that the difference between the pressure of the fuel and the pressure inside the intake ports is constant. Therefore, if the fuel injection valves 33 are normal, the fuel injection valves 33 inject the amount of fuel equal to the commanded fuel injection amount. However, if an abnormality occurs on a fuel injection valve 33, the fuel injection valve 33 comes to inject an amount of fuel that is different from the commanded fuel injection amount. Due to this, there occurs non-uniformity of the cylinder-by-cylinder air/fuel ratios of the cylinders.

The throttle valve 34 is disposed pivotably within the intake pipe 32. The throttle valve 34 is capable of varying the cross-sectional area of the opening of the intake passageway. The throttle valve 34 is rotationally driven within the intake pipe 32 by a throttle valve actuator (not shown).

The exhaust system 40 includes an exhaust manifold 41, an exhaust pipe 42, an upstream-side catalyst 43 disposed on the exhaust pipe 42, and a "downstream-side catalyst" disposed on the exhaust pipe 42 downstream of the upstream-side catalyst 43.

The exhaust manifold 41 includes a plurality of branch portions 41*a* and a confluence portion 41*b*. An end of each of the branch portions 41*a* is connected to a corresponding one of exhaust ports. The other-side ends of the branch portions 41*a* merge into the confluence portion 41*b*. This confluence portion 41*b* is a portion where the flows of exhaust gas discharged from a plurality of cylinders (i.e., two or more cylinders and, in this embodiment, four cylinders) meet, and is therefore also referred to as "exhaust confluence portion HK".

The exhaust pipe 42 is connected to the confluence portion 41*b*. The exhaust ports, the exhaust manifold 41 and the exhaust pipe 42 constitute an exhaust passageway.

Each of the upstream-side catalyst 43 and the downstream-side catalyst is a so-called three-way catalyst device (that is an exhaust gas control catalyst) loaded with a noble metal (catalyst material) such as platinum, rhodium, palladium, etc. Each of the two catalysts has a function of oxidizing unburned components of fuel, such as HC, CO, $H_2$, etc., and reducing nitrogen oxides (NOx) when the air/fuel ratio of gas that flows into the catalyst is an air/fuel ratio that is within the window of the three-way catalyst (e.g., the stoichiometric air/fuel ratio)". This function is also referred to as catalytic function. Furthermore, each of the catalysts has an oxygen storage capability of storing (accumulating) oxygen. Due to the oxygen storage function, each catalyst is capable of substantially removing the unburned components and the nitrogen oxides even when the air/fuel ratio is deviated from the stoichiometric air/fuel ratio. That is, the oxygen storage function increases the width of the window. The oxygen storage function is brought about by an oxygen storage material, such as ceria ($CeO_2$) or the like, that is supported in the catalyst.

This system includes a hot wire type air flow meter 51, a throttle position sensor 52, a cooling liquid temperature sensor 53, a crank position sensor 54, an intake cam position sensor 55, an upstream-side air/fuel ratio sensor 56, a downstream-side oxygen concentration sensor 57, an accelerator operation amount sensor 58, and a vehicle speed sensor 59.

The air flow meter 51 outputs a signal commensurate with the mass flow amount of intake air (intake air flow amount) Ga that flows in the intake pipe 32. That is, the intake air amount Ga represents the amount of intake air that is taken into the engine 10 per unit time.

The throttle position sensor 52 detects the degree of opening of the throttle valve 34 (throttle valve opening degree), and outputs a signal that represents the throttle valve opening degree TA.

The cooling liquid temperature sensor 53 detects the temperature of the cooling liquid of the internal combustion engine 10, and outputs a signal that represents the cooling liquid temperature THW. The cooling liquid temperature THW is a parameter that represents the state of warm-up of the engine 10 (the temperature of the engine 10).

The crank position sensor 54 outputs a signal that has a narrow-width pulse every time the crankshaft turns 10°, and that has a broad-width pulse every time the crankshaft turns 360°. This signal is converted into the engine rotation speed NE by an electric control device 70 described below.

The intake cam position sensor 55 outputs a pulse every time the intake cam shaft turns by any one of an angle of 90 degrees from a predetermined angle, another 90 degrees and a further angle of 180 degrees from the angle of 90 degrees from the predetermined angle. The electric control device 70 described below acquires an absolute crank angle CA that is determined with reference to the compression top dead center of a reference cylinder (e.g., the first cylinder) on the basis of the signals from the crank position sensor 54 and the intake cam position sensor 55. This absolute crank angle CA is, according to its setting, "0 crank angle [deg]" at the compression top dead center of the reference cylinder, and increases to 720 crank angle [deg] according to the rotation angle of the crankshaft, and at that point, becomes 0 crank angle [deg] again.

The upstream-side air/fuel ratio sensor 56 is disposed on "either one of the exhaust manifold 41 and the exhaust pipe 42" between the confluence portion 41*b* (exhaust confluence portion HK) of the exhaust manifold 41 and the upstream-side catalyst 43. The upstream-side air/fuel ratio sensor 56 is also referred to simply as "air/fuel ratio sensor".

The upstream-side air/fuel ratio sensor 56 is, for example, a "limiting current type wide-range air/fuel ratio sensor equipped with a diffusion resistance layer" that is disclosed in Japanese Patent Application Publication No. 11-72473 (JP-A-11-72473), Japanese Patent Application Publication No. 2000-65782 (JP-A-2000-65782), Japanese Patent Application Publication No. 2004-69547 (JP-A-2004-69547), etc.

Figure 2:
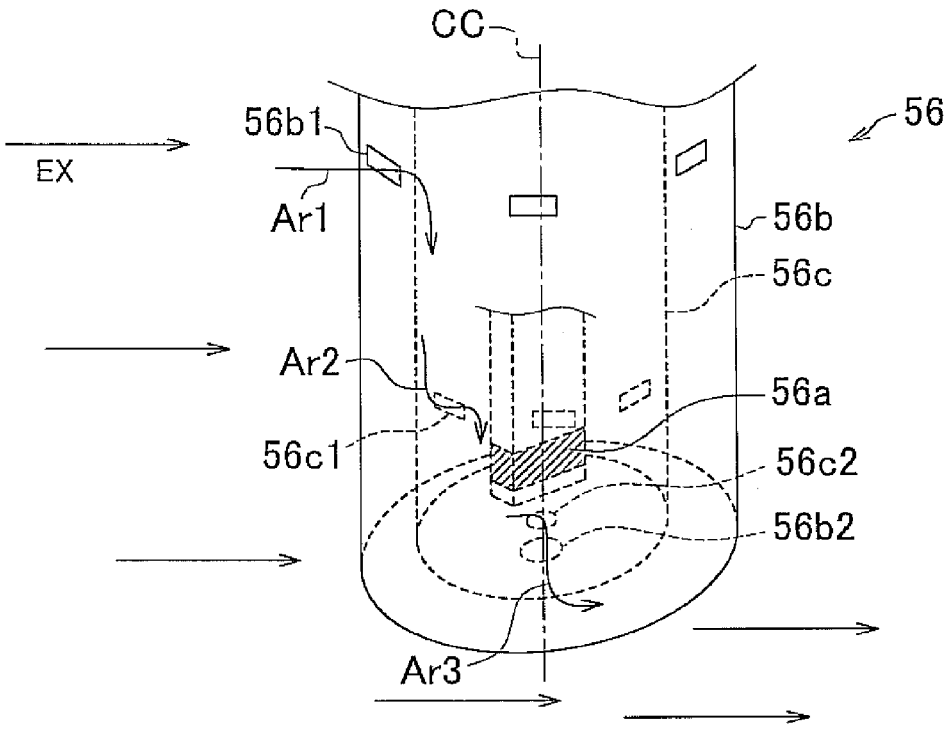
FIG. 2 is a schematic partial perspective view (open-up view) of the upstream-side air/fuel ratio sensor (air/fuel ratio sensor) shown in FIG. 1.
Figure 3:
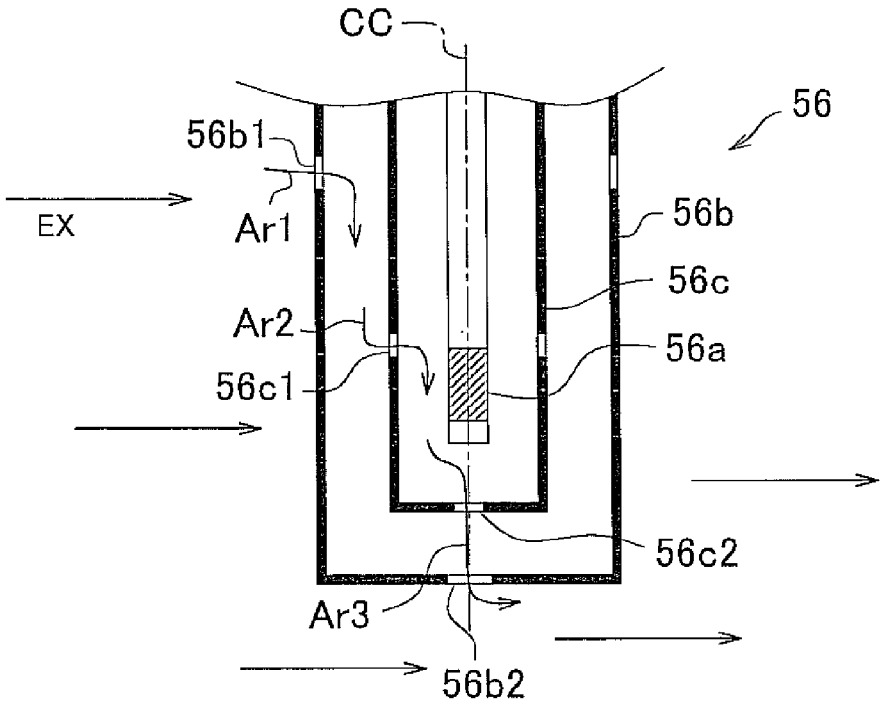
FIG. 3 is a partial sectional view of the air/fuel ratio sensor shown in FIG. 1.

The upstream-side air/fuel ratio sensor 56 has an air/fuel ratio detection portion 56*a*, an outer protective cover 56*b*, and an inner protective cover 56*c*, as shown in FIG. 2 and FIG. 3.

The outer protective cover 56*b* is a hollow cylindrical body made of a metal. The outside protective cover 56*b* houses therein the inner protective cover 56*c* so as to cover the inner protective cover 56*c*. The side surface of the outer protective cover 56*c* is provided with a plurality of inflow holes 56*b*1. The inflow holes 56*b*1 are through holes for allowing the exhaust gas flowing in the exhaust passageway (exhaust gas outside the outer protective cover 56*b*) EX to flow into the outer protective cover 56*b*. Furthermore, the outer protective cover 56*b* has in a bottom surface thereof an outflow hole 56*b*2 for allowing the exhaust gas inside the outer protective cover 56*b* to flow out into the outside (exhaust passageway).

The inner protective cover 56*c* is a hollow cylindrical body made of a metal and having a diameter that is smaller than the diameter of the outer protective cover 56*b*. The inner protective cover 56*c* houses therein the air/fuel ratio detection portion 56*a* so as to cover the air/fuel ratio detection portion 56*a*. The side surface of the inner protective cover 56*c* is provided with inflow holes 56*c*1. The inflow holes 56*c*1 are through holes that allow the exhaust gas having flown into a "space between the outer protective cover 56*b* and the inner protective cover 56*c*" through the inflow hole 56*b*1 of the outside protective cover 56*b* to flow into the inside of the protective cover 56*b*. Furthermore, the inner protective cover 56*c* has in its bottom surface an outflow hole 56*c*2 for allowing the exhaust gas within the inner protective cover 56*c* to flow out into the outside.

Figure 4A:
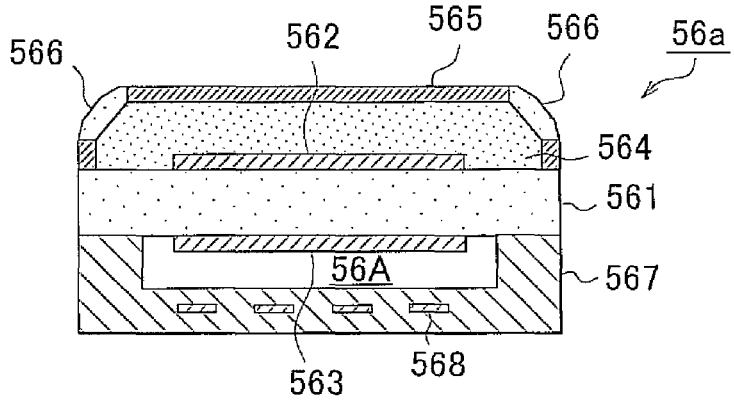
FIGS. 4A to 4C are schematic sectional views of an air/fuel ratio detection portion provided in the upstream-side air/fuel ratio sensor shown in FIG. 1.
Figure 4B:
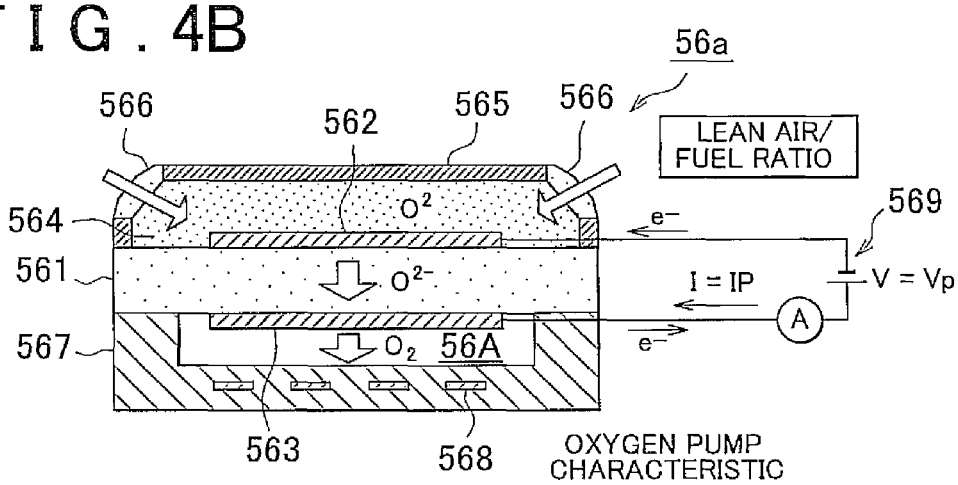
Figure 4C:
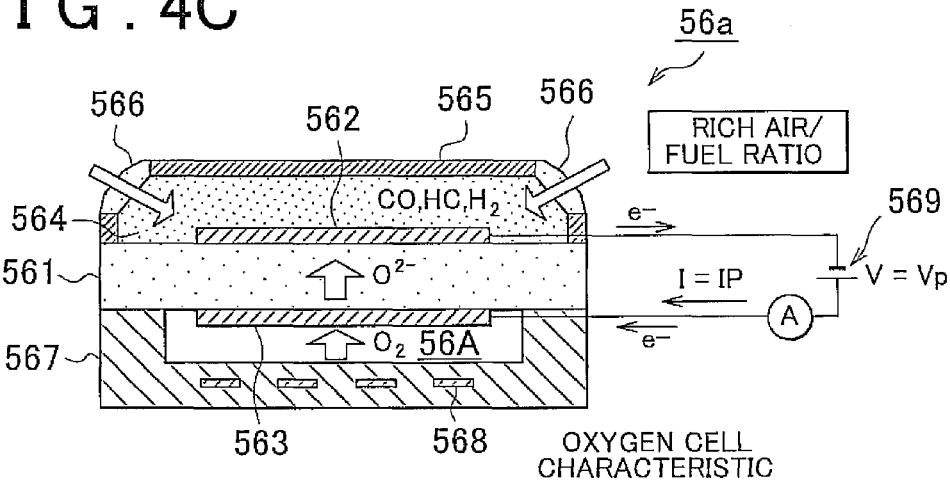

As shown in FIGS. 4A to 4C, the air/fuel ratio detection portion 56*a* includes a solid electrolyte layer (i.e., air/fuel ratio detection element) 561, an exhaust gas-side electrode layer 562, an atmosphere-side electrode layer 563, a diffusion resistance layer 564, a first wall portion 565, catalyst portions 566, a second wall portion 567, and a heater 568.

The solid electrolyte layer 561 is an oxygen ion conductive oxide sintered body. In this embodiment, the solid electrolyte layer 561 is a "stabilized zirconia circuit element" in which CaO is dissolved as a stabilizer in $ZrO^2$ (zirconia) in a solid state. The solid electrolyte layer 561 exhibits a well-known "oxygen cell characteristic" and a well-known "oxygen pump characteristic" when its temperature is higher than or equal to an activation temperature.

The exhaust gas-side electrode layer 562 is made of a noble metal whose catalytic activity is high, such as platinum (Pt) or the like. The exhaust gas-side electrode layer 562 is formed on a surface of the solid electrolyte layer 561. The exhaust gas-side electrode layer 562 is formed by chemical plating or the like so as to have sufficient permeability (i.e., be porous).

The atmosphere-side electrode layer 563 is made of a noble metal whose catalytic activity is high, such as platinum (Pt) or the like. The atmosphere-side electrode layer 563 is formed on the other side surface of the solid electrolyte layer 561 so as to face the exhaust gas-side electrode layer 562 across the solid electrolyte layer 561. The atmosphere-side electrode layer 563 is formed by chemical plating or the like so as to have sufficient permeability (i.e., be porous).

The diffusion resistance layer (diffusion rate-determining layer) 564 is made of a porous ceramics (heat-resistant inorganic material). The diffusion resistance layer 564 is formed by, for example, a plasma spraying process, so as to cover the outside surface of the exhaust gas-side electrode layer 562.

The first wall portion 565 is made of an alumina ceramics that is compact and does not permeate gas. The first wall portion 565 is formed so as to cover the diffusion resistance layer 564 except corner portions of the diffusion resistance layer 564 (i.e., portions thereof). In other words, the first wall portion 565 has through-hole portions that expose portions of the diffusion resistance layer 564.

The catalyst portions 566 are formed so as to close the through-hole portions of the first wall portion 565. The catalyst portions 566, as in the upstream-side catalyst 43, is loaded with a catalyst material that accelerates oxidation-reduction reactions and an oxygen storing material that exhibits the oxygen storage function. The catalyst portions 566 are made of a porous material. Therefore, as shown by blank arrows in FIG. 4B and FIG. 4C, the exhaust gas (the exhaust gas having flown into the inside of the inner protective cover 56*c*) passes through the catalyst portion 566 to arrive at the diffusion resistance layer 564, and passes through the diffusion resistance layer 564 to arrive at the exhaust gas-side electrode layer 562.

The second wall portion 567 is made of an alumina ceramics that is compact and does not permeate gas. The second wall portion 567 is constructed to form an "atmospheric chamber 56A" that is a space that houses the atmosphere-side electrode layer 563. Atmospheric air is introduced into the atmospheric chamber 56A.

An electric power supply 569 is connected to the upstream-side air/fuel ratio sensor 56. The electric power supply 569 applies voltage V (=Vp) so that the atmosphere-side electrode layer 563 becomes higher in electric potential and the exhaust gas-side electrode layer 562 is lower in electric potential The heater 568 is buried in the second wall portion 567. The heater 568, when electrified by the electric control device 70 described below, generates heat to heat the solid electrolyte layer 561, the exhaust gas-side electrode layer 562 and the atmosphere-side electrode layer 563, and thus adjust the temperature thereof.

Figure 5:
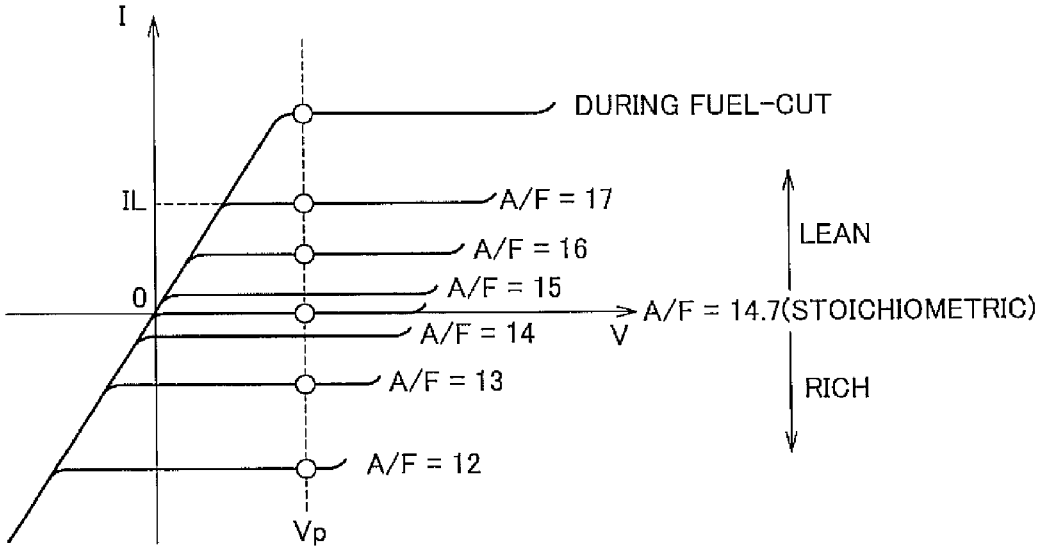
FIG. 5 is a graph showing a relation between the air/fuel ratio (upstream-side air/fuel ratio) of exhaust gas and the limiting current value of the air/fuel ratio sensor.

The upstream-side air/fuel ratio sensor 564 having a structure as described above ionizes oxygen having arrived at the exhaust gas-side electrode layer 562 through the diffusion resistance layer 564 and allows the ionized oxygen to pass to the atmosphere-side electrode layer 563, when the air/fuel ratio of the exhaust gas is to the lean side of the stoichiometric air/fuel ratio, as shown in FIG. 4B. As a result, current I flows from the positive electrode to the negative electrode of the electric power supply 569. The magnitude of the current I, if the voltage V is set at a predetermined voltage Vp as shown in FIG. 5, becomes a constant value that is proportional to the concentration of oxygen that reaches the exhaust gas-side electrode layer 562 (oxygen partial pressure, that is, the exhaust gas air/fuel ratio). The upstream-side air/fuel ratio sensor 56 outputs a value of voltage converted from the aforementioned current (i.e., the limiting current value IL) as an output value Vabyfs.

On the other hand, when the air/fuel ratio of the exhaust gas is an air/fuel ratio on the rich side of the stoichiometric air/fuel ratio as shown in FIG. 4C, the upstream-side air/fuel ratio sensor 56 ionizes the oxygen present in the atmospheric chamber 56A and leads the ionized oxygen to the exhaust gas-side electrode layer 562, so that the ionized oxygen oxidizes the unburned materials (HC, CO, $H_2$, etc.) that arrive at the exhaust gas-side electrode layer 562 through the diffusion resistance layer 564. As a result, current I flows from the negative electrode to the positive electrode of the electric power supply 569. The magnitude of the current I, if the voltage V is set at the predetermined value Vp as shown in FIG. 5, becomes a constant value that is proportional to the concentration of the unburned materials arriving at the exhaust gas-side electrode layer 562 (i.e., the air/fuel ratio of exhaust gas). The upstream-side air/fuel ratio sensor 56 outputs a value of voltage converted from the aforementioned current (i.e., the limiting current value IL) as an output value Vabyfs.

Figure 6:
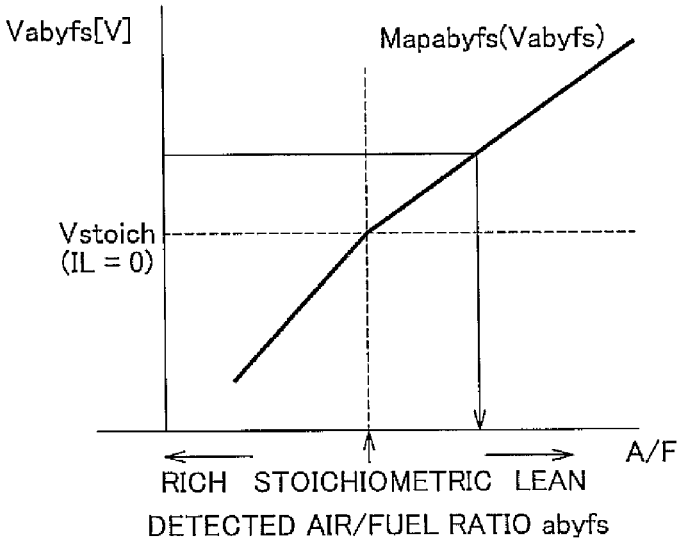
FIG. 6 is a graph showing a relation between the air/fuel ratio (upstream-side air/fuel ratio sensor) of exhaust gas and the output value of the air/fuel ratio sensor.

That is, the air/fuel ratio detection portion 56*a* outputs as an "air/fuel ratio sensor output" the output value Vabyfs that is commensurate with the air/fuel ratio of the gas that flows by the position where the upstream-side air/fuel ratio sensor 56 is disposed, and then arrives at the air/fuel ratio detection portion 56*a* through the inflow holes 561 of the outer protective cover 56*b* and the inflow holes 56*c*1 of the inner protective cover 56*c*. The output value Vabyfs increases with increase in the air/fuel ratio of the gas that arrives at the air/fuel ratio detection portion 56*a* (with changes thereof to the lean side). That is, the output value Vabyfs is substantially proportional to the air/fuel ratio of the exhaust gas that arrives at the air/fuel ratio detection portion 56*a* as shown in FIG. 6. Incidentally, the output value Vabyfs becomes equal to a stoichiometric air/fuel ratio-equivalent value Vstoich when the air/fuel ratio of the gas that arrives at the air/fuel ratio detection portion 56*a* is equal to the stoichiometric air/fuel ratio.

Thus, the upstream-side air/fuel ratio sensor 56 can be said to "be an air/fuel ratio sensor that is disposed at a position on the exhaust passageway of the engine 10 between the exhaust confluence portion HK and the three-way catalyst 43, and that has: the air/fuel ratio detection element (solid electrolyte layer) 561; the exhaust gas-side electrode layer 562 and the atmosphere-side electrode layer (i.e., reference gas-side electrode layer) 563 that are disposed so as to face each other across the air/fuel ratio detection element 561; the porous material layer (diffusion resistance layer) 564 that covers the exhaust gas-side electrode layer 562, and that outputs an output value commensurate with the amount of oxygen (oxygen concentration or oxygen partial pressure) and the amount of unburned materials contained in the exhaust gas that arrives at the exhaust gas-side electrode layer 562 through the porous material layer 564, of the exhaust gas that passes the position where the air/fuel ratio sensor is disposed".

The electric control device 70 stores an air/fuel ratio conversion table (map) Mapabyfs shown in FIG. 6. The electric control device 70 detects the actual upstream-side air/fuel ratio abyfs (i.e., acquires a detected air/fuel ratio abyfs) by applying the output value Vabyfs of the upstream-side air/fuel ratio sensor 56 to the air/fuel ratio conversion table Mapabyfs.

The upstream-side air/fuel ratio sensor 56 is disposed at a position between the exhaust confluence portion HK and the upstream-side catalyst 43 as mentioned above. Furthermore, the outside protective cover 56*b* of the upstream-side air/fuel ratio sensor 56 is disposed so as to be exposed to either one of the inside of the exhaust manifold 41 or the inside of the exhaust pipe 42.

More concretely, the upstream-side air/fuel ratio sensor 56 is disposed as shown in FIGS. 2 and 3 so that the bottom surfaces of the protective covers (56*b* and 56*c*) are parallel with the flow of exhaust gas EX and a center axis CC is orthogonal to the flow of exhaust gas EX. Due to this, the exhaust gas EX in the exhaust passageway that reaches the inflow holes 56*b*1 of the outer protective cover 56*b* is sucked into the inside of the outer protective cover 56*b* and the inner protective cover 56*c* because of the flow of the exhaust gas EX in the exhaust passageway that flows in the vicinity of the outflow holes 56*b*2 of the outer protective cover 56*b*.

Therefore, exhaust gas EX that flows in the exhaust passageway passes through the inflow holes 56*b*1 of the outer protective cover 56*b* and flows into a space between the outer protective cover 56*b* and the inner protective cover 56*c* as shown by an arrow Ar1 in FIGS. 2 and 3. Next, the exhaust gas flows into the "inside of the inner protective cover 56*c*" through the "inflow hole 56*c*1 of the inner protective cover 56*c*", and then arrives at the air/fuel ratio detection portion 56*a* as shown by an arrow Ar2. After that, the exhaust gas flows out into the exhaust passageway through "the outflow holes 56*c*2 of the inner protective cover 56*c* and the outflow holes 56*b*2 of the outer protective cover 56*b*".

The flow rate of exhaust gas inside "the outer protective cover 56*b* and the inner protective cover 56*c*" changes according to the flow rate of exhaust gas EX flowing in the vicinity of the outflow hole 56*b*2 of the outer protective cover 56*b* (therefore, according to the intake air amount Ga that is the amount of air taken in per unit time). In other words, the time from the "time point when the exhaust gas of a certain air/fuel ratio (first exhaust gas) arrives at the inflow hole 56*b*1" to the "time point when the first exhaust gas arrives at the air/fuel ratio detection portion 56*a*" is dependent on the intake air amount Ga but not dependent on the engine rotation speed NE. Therefore, the output responsiveness (responsiveness) of the upstream-side air/fuel ratio sensor 56 to the "air/fuel ratio of exhaust gas flowing in the exhaust passageway" is better the greater the amount of flow (the flow rate) of exhaust gas flowing in the vicinity of the outer protective cover 56*b* of the upstream-side air/fuel ratio sensor 56, that is, the greater the intake air amount Ga. This holds as well in the case where the upstream-side air/fuel ratio sensor 56 does not have the outer protective cover 56*b* and has only the inner protective cover 56*c*.

Referring back to FIG. 1, the downstream-side oxygen concentration sensor 57 is disposed in the exhaust pipe 42. The position at which the downstream-side oxygen concentration sensor 57 is a position that is downstream of the upstream-side catalyst 43 and that is upstream of the downstream-side catalyst (i.e., is in the exhaust passageway between the upstream-side catalyst 43 and the downstream-side catalyst). The downstream-side oxygen concentration sensor 57 is a well-known electromotive force type oxygen concentration sensor (a well-known concentration cell type oxygen concentration sensor that employs a solid electrolyte such as stabilized zirconia or the like). The downstream-side oxygen concentration sensor 56 produces an output value Voxs that is commensurate with the air/fuel ratio of a detection-object gas that is a gas that passes through a site in the exhaust passageway at which the downstream-side oxygen concentration sensor 57 is disposed. In other words, the output value Voxs is a value commensurate with the air/fuel ratio of the gas that has flown out from the upstream-side catalyst 43 and that is to flow into the downstream-side catalyst.

Figure 7:
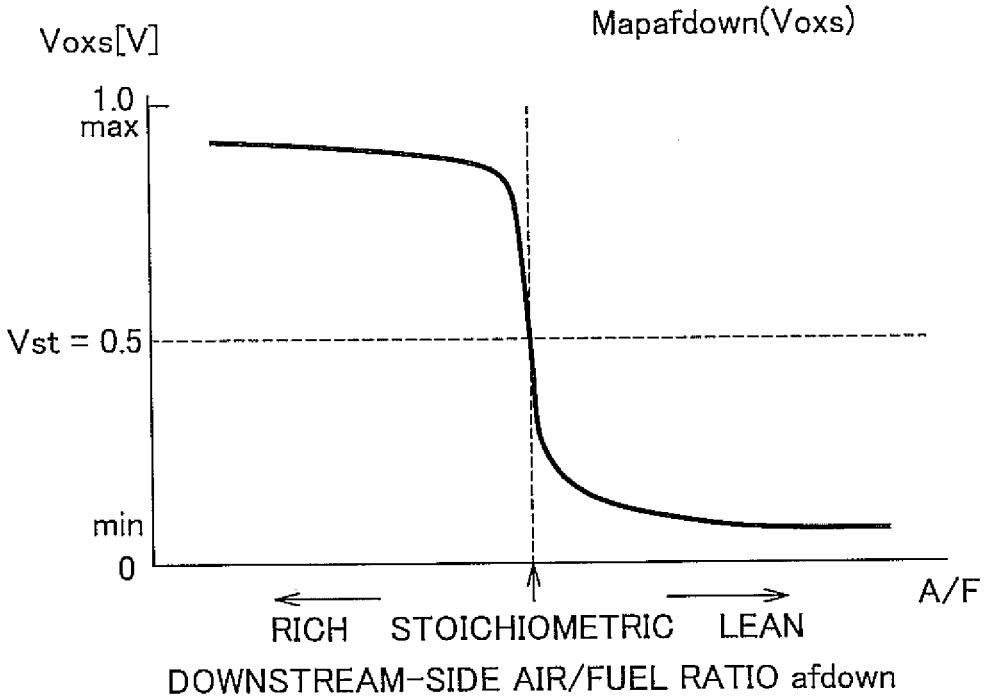
FIG. 7 is a graph showing a relation between the output value of the air/fuel ratio (downstream-side air/fuel ratio) of exhaust gas and the output value of a downstream-side electromotive force type oxygen concentration sensor (downstream-side air/fuel ratio sensor) shown in FIG. 1.

This output value Voxs reaches a maximum output value max (e.g., about 0.9 V to 1.0 V) when the air/fuel ratio of the detection-object gas is richer than the stoichiometric air/fuel ratio, as shown in FIG. 7. The output value Voxs reaches a minimum output value min (e.g., about 0.1 V to 0 V) when the air/fuel ratio of the detection-object gas is leaner than the stoichiometric air/fuel ratio. Furthermore, the output value Voxs becomes a voltage Vst that is substantially in the middle between the maximum output value max and the minimum output value mini (i.e., an intermediate value Vst, for example, about 0.5 V) when the air/fuel ratio of the detection-object gas is the stoichiometric air/fuel ratio. The output value Voxs sharply changes from the maximum output value max to the minimum output value minimum as the air/fuel ratio of the detection-object gas changes from an air/fuel ratio richer than the stoichiometric air/fuel ratio to an air/fuel ratio leaner than the stoichiometric air/fuel ratio. Likewise, when the air/fuel ratio of the detection-object gas changes from an air/fuel ratio leaner than the stoichiometric air/fuel ratio to an air/fuel ratio richer than the stoichiometric air/fuel ratio, the output value Voxs sharply changes from the minimum output value min to the maximum output value max.

The accelerator operation amount sensor 58 shown in FIG. 1 outputs a signal that represents the amount of operation Accp of an accelerator pedal AP that is operated by a driver (i.e., the accelerator pedal operation amount, or the degree of depression of the accelerator pedal AP). The accelerator pedal operation amount Accp increases with increases in the amount of operation of the acceleration pedal AP.

The vehicle speed sensor 59 outputs a signal that represents the speed spd of the vehicle in which the engine 10 is mounted (vehicle speed spd).

The electric control device 70 is a well-known microcomputer made up of: "a CPU; a ROM that stores programs that the CPU executes as well as tables (maps and functions), constants, etc. beforehand; a RAM into which the CPU temporarily stores data according to need; a backup RAM; an interface that includes an AD converter; etc."

The backup RAM is supplied with electric power from a battery mounted in the vehicle in which the engine 10 is mounted, regardless of the operation position of an ignition key switch (not shown) of the vehicle (any one of the off-position, the start position, the on-position, etc. of the ignition key switch). The backup RAM, while being supplied with electric power from the battery, stores data (allows data to be written thereinto) according to the command from the CPU and retains (stores) the data so that the data can be read out. Therefore, the backup RAM is able to retain data even when the engine 10 has stopped operating.

The backup RAM is not able to retain data when the supply of electric power from the battery is shut down, for example, due to removal of the battery from the vehicle, or the like. Therefore, the CPU initializes the data to be retained by the backup RAM (sets the data to default values) when the supply of electric power to the backup RAM is started again. Incidentally, the backup RAM may be a readable/writable non-volatile memory such as an erasable programmable read-only memory (EPROM) or the like.

The electric control device 70 is connected to the aforementioned sensors and the like, and supplies the signals received from the sensors to the CPU. Furthermore, the electric control device 70, according to the command from the CPU, sends out drive signals (command signals) to the ignition plugs provided corresponding to the cylinders (actually, to an igniter), the fuel injection valves 33 provided corresponding to the cylinders, the throttle valve actuator, etc.

Incidentally, the electric control device 70 sends out such a command signal to the throttle valve actuator that the throttle valve opening degree TA becomes greater the greater the acquired operation amount Accp of the accelerator pedal. That is, the electric control device 70 is equipped with a throttle valve drive device that changes the degree of opening of the throttle valve 34 disposed in the intake passageway" according to the amount of accelerating operation of the engine 10 that is changed by a driver (according to the accelerator pedal operation amount Accp).

Next, the inter-cylinder air/fuel ratio imbalance determination that is executed by the first-embodiment determination apparatus will be generally described. The first-embodiment determination apparatus performs a feedback correction (i.e., increases or decreases) the commanded fuel injection amount so that the detected air/fuel ratio abyfs represented by the output value Vabyfs of the upstream-side air/fuel ratio sensor 56 becomes equal to a "target air/fuel ratio (target upstream-side air/fuel ratio) abyfr". That is, the first-embodiment determination apparatus executes a main feedback control. Furthermore, the first-embodiment determination apparatus feedback-controls (increases or decreases) the commanded fuel injection amount so that the output value Voxs of the downstream-side oxygen concentration sensor 57 becomes equal to a target downstream-side value Voxsref. That is, the first-embodiment determination apparatus executes a subsidiary feedback control.

The first-embodiment determination apparatus acquires an air/fuel ratio imbalance index value RIMBh that becomes larger the larger the degree of non-uniformity of the cylinder-by-cylinder air/fuel ratios, as an imbalance determination parameter for determining whether or not there has occurred an inter-cylinder air/fuel ratio imbalance state. Actually, if a predetermined parameter acquisition condition (air/fuel ratio imbalance index value acquisition condition) is satisfied during a period during which the main feedback control (and the subsidiary feedback control) is executed, the first-embodiment determination apparatus acquires, on the basis of the output value Vabyfs of the air/fuel ratio sensor 56, the air/fuel ratio fluctuation index quantity AFD that becomes larger the larger the fluctuation of the output value Vabyfs becomes. The air/fuel ratio fluctuation index quantity AFD is adopted as an air/fuel ratio imbalance index value RIMBh.

(1) The first-embodiment determination apparatus, if the aforementioned parameter acquisition condition is satisfied, acquires the "amount of change in every predetermined unit time" in the "output value Vabyfs of the air/fuel ratio sensor 56 (or a high-pass filter-processed output value (VHPF) obtained by subjecting the output value Vabyfs to a high-pass filter process)" every time a predetermined time (constant sampling time ts) elapses.

This "amount of change per unit time in the output value Vabyfs" can be said to be a differential value (a time differential value d(Vabyfs)/dt, or a first-order differential value d(Vabyfs)/dt) with respect to the output value Vabyfs, if the unit time is a very short time, for example, of about 4 ms. Therefore, the "amount of change per unit time in the output value Vabyfs" is also referred to as "rate of change ΔAF" or "slope ΔAF". Furthermore, the rate of change ΔAF is also referred to as "basic index quantity" or "basic parameter".

(2) The first-embodiment determination apparatus obtains an average value Ave of the absolute values |ΔAF| of a plurality of rates of change ΔAF that are acquired during one unit combustion cycle period. The unit combustion cycle period is the period of the turning of the crank angle that is required for all the cylinders that discharge exhaust gas that reaches the air/fuel ratio sensor 56 to complete one combustion stroke. The engine 10 in this embodiment is an in-line four-cylinder four-stroke engine, and exhaust gas from the first to fourth cylinders of the engine 10 reaches the air/fuel ratio sensor 56. Therefore, the unit combustion cycle period is the period of the turning of 720 crank angle [deg].

(3) The first-embodiment determination apparatus obtains as a "pre-correction index quantity RIMB (pre-correction air/fuel ratio fluctuation index quantity)" the average value of the average values AveΔAF obtained for each of a plurality of unit combustion cycle periods. (4) The first-embodiment determination apparatus corrects the pre-correction index quantity RIMB so that the pre-correction index quantity RIMB becomes smaller the greater a "correction-purpose output value AveVaf (described below)", on the basis of a correction-purpose output value AveVafh (actually, a correction-purpose output value AveVafh obtained by correcting the correction-purpose output value AveVaf by the element's temperature), and adopts the corrected value (post-correction index quantity) as an air/fuel ratio fluctuation index quantity AFD (i.e., an air/fuel ratio imbalance index value RIMBh).

The first-embodiment determination apparatus determines that the inter-cylinder air/fuel ratio imbalance state has occurred, when the air/fuel ratio imbalance index value RIMBh is greater than or equal to an imbalance determination threshold value Rth. When the air/fuel ratio imbalance index value RIMBh is less than the imbalance determination threshold value Rth, the first-embodiment determination apparatus determines that the inter-cylinder air/fuel ratio imbalance state has not occurred.

The pre-correction index quantity RIMB (i.e., a value that correlates with the rate of change ΔAF) obtained as described above is a value that becomes larger the larger the "the degree of non-uniformity in air/fuel ratio between cylinders, that is, the cylinder-by-cylinder air/fuel ratio difference". A reason for this will be described below.

The exhaust gases from the cylinders reach the air/fuel ratio sensor 56 in the order of being ignited (thereof, the order of being discharged). In the case where there is no cylinder-by-cylinder air/fuel ratio difference (where there is no occurrence of non-uniformity of the cylinder-by-cylinder air/fuel ratios), the air/fuel ratios of the exhaust gases that are discharged from the cylinders and that reach the air/fuel ratio sensor 56 are substantially equal to each other. Therefore, the output value Vabyfs given when there is no cylinder-by-cylinder air/fuel ratio difference changes, for example, as shown by an interrupted line C1 in FIG. 8B. That is, in the case where there is no non-uniformity in air/fuel ratio between the cylinders, the waveform of the output value Vabyfs of the air/fuel ratio sensor 56 is substantially flat. Therefore, as shown by an interrupted line C3 in FIG. 8C, in the case where there is no cylinder-by-cylinder air/fuel ratio difference, the absolute value of the rate of change ΔAF (differential value d(Vabyfs)/dt) is small.

On another hand, if the characteristic of the "fuel injection valve 33 that injects fuel into a specific cylinder (e.g., the first cylinder) becomes a "characteristic of injecting a larger amount of fuel than the commanded fuel injection amount", the cylinder-by-cylinder air/fuel ratio difference becomes large. That is, the air/fuel ratio of the exhaust gas from that specific cylinder (the air/fuel ratio of the imbalance cylinder) and the air/fuel ratio of the exhaust gas from the cylinders other than the specific cylinder (the air/fuel ratio of the non-imbalance cylinders) are greatly different from each other.

Figure 8A:
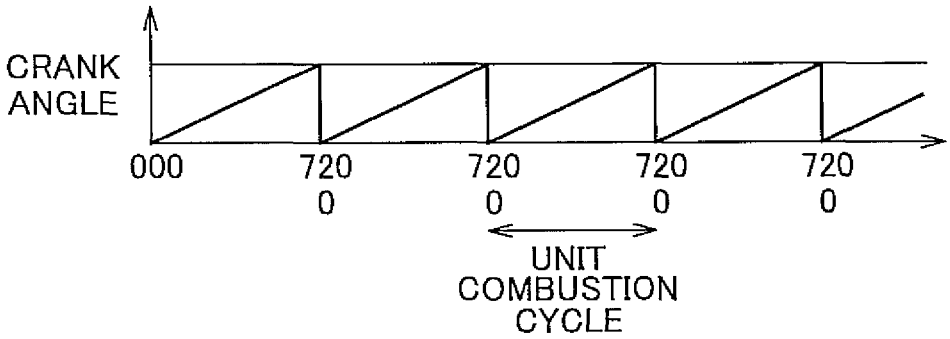
FIGS. 8A to 8D are time charts showing "behaviors of various values related to the air/fuel ratio imbalance index quantity" in the case where an inter-cylinder air/fuel ratio imbalance state has occurred (where the non-uniformity of the cylinder-by-cylinder air/fuel ratios is great) and the case where the inter-cylinder air/fuel imbalance state is not occurring (where non-uniformity of the cylinder-by-cylinder air/fuel ratios is not present)
Figure 8B:
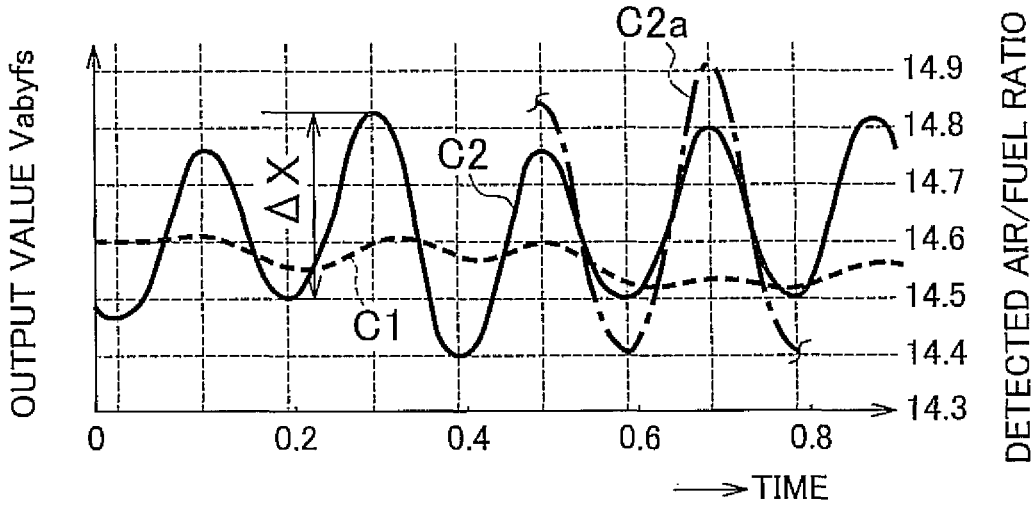

Therefore, the output value Vabyfs given when the inter-cylinder air/fuel ratio imbalance state exists fluctuates greatly in every unit combustion cycle period, for example, as shown by a solid line C2 in FIG. 8B. Due to this, as shown by a solid line C4 in FIG. 8C, in the case where the inter-cylinder air/fuel ratio imbalance state exists, the absolute value of the rate of change ΔAF (differential value d(Vabyfs)/dt) becomes large.

Furthermore, the rate of change ΔAF fluctuates so greatly that the air/fuel ratio of an imbalance cylinder becomes considerably apart from the air/fuel ratio of the non-imbalance cylinders. For example, assuming that the output value Vabyfs given when the magnitude of the difference between the air/fuel ratio of the imbalance cylinder and the air/fuel ratio of the non-imbalance cylinders changes as shown by the solid line C2 in FIG. 8B, the output value Vabyfs given when the magnitude of the difference between the air/fuel ratio of the imbalance cylinder and the air/fuel ratio of the non-imbalance cylinders is a "second value that is larger than the first value" changes as shown by a one-dot chain line C2*a* in FIG. 8B.

Figure 9:
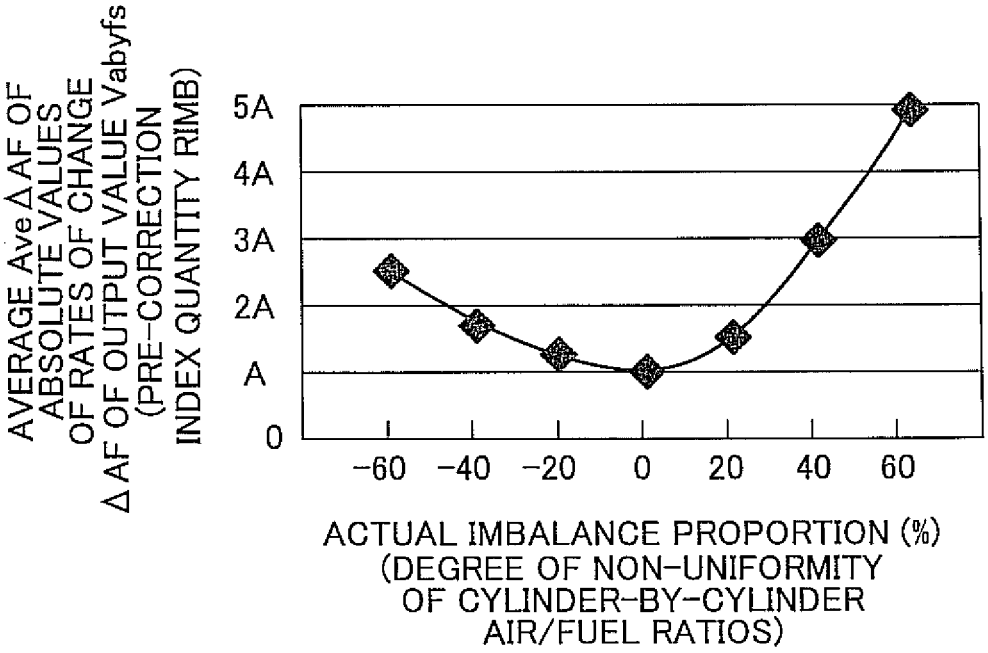
FIG. 9 is a graph showing a relation between the degree of non-uniformity of actual air/fuel ratio imbalance index values (imbalance proportion) and the air/fuel ratio imbalance index value that correlates with the rate of change of the output value of the upstream-side air/fuel ratio sensor.

Hence, as shown in FIG. 9, the average value AveΔAF (pre-correction index quantity RIMB) of the absolute values |ΔAF| of the rates of change ΔAF during a "plurality of unit combustion cycle periods" becomes greater the more apart from the air/fuel ratio of the non-imbalance cylinders the air/fuel ratio of the imbalance cylinder becomes (the greater the actual imbalance proportion becomes).

Figure 10A:
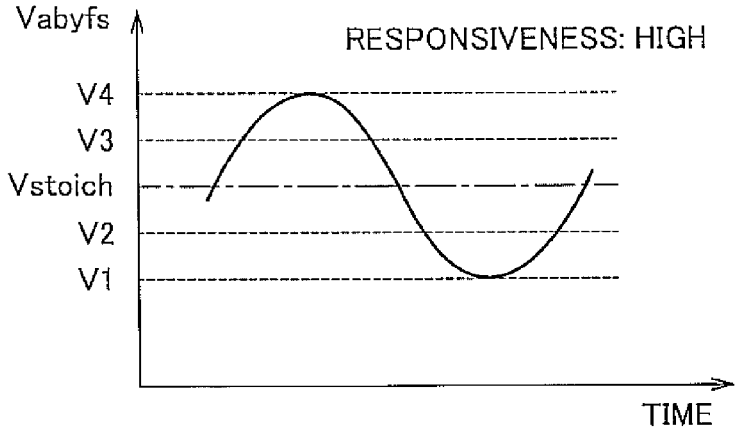
FIGS. 10A to 10C are time charts showing a "manner of change of the output value of the air/fuel ratio sensor" when the air/fuel ratio sensors varies in responsiveness in the case where the degree of non-uniformity of the cylinder-by-cylinder air/fuel ratios is equal to a specific value.
Figure 10B:
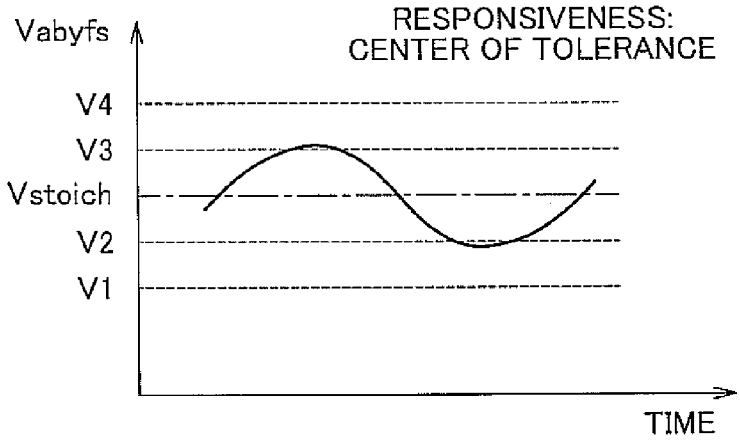
Figure 10C:
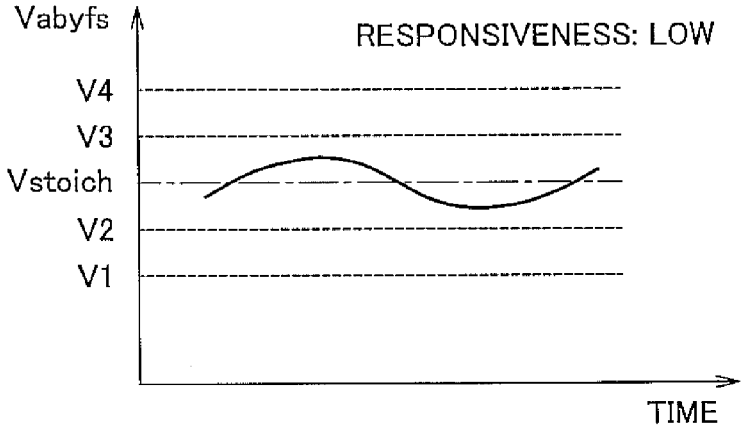

Incidentally, individual air/fuel ratio sensors 56 are different from each other in responsiveness. That is, the air/fuel ratio sensors have individual product differences. Due to this, in the case where the degree of non-uniformity of the cylinder-by-cylinder air/fuel ratios is "a specific value", the output value of a high-responsiveness air/fuel ratio sensor fluctuates relatively greatly as shown in FIG. 10A, and the output value of an air/fuel ratio sensor with a responsiveness of a middle value of the tolerance fluctuates with an intermediate amplitude as shown in FIG. 10B, and the output value of a low-responsiveness air/fuel ratio sensor fluctuates to a relatively small degree as shown in FIG. 10C.

That is, even if the degree of non-uniformity of the cylinder-by-cylinder air/fuel ratios is the "specific value", the manner of fluctuation of the output value Vabyfs of the air/fuel ratio sensor 56 varies according to the responsiveness of the air/fuel ratio sensor 56. Therefore, even if the pre-correction index quantity RIMB is a "certain value", there can occur a case where the degrees of non-uniformity of the cylinder-by-cylinder air/fuel ratios vary. As a result, if the pre-correction index quantity RIMB is directly adopted as an air/fuel ratio imbalance index value and the imbalance determination is executed on the basis of the air/fuel ratio imbalance index value and the imbalance determination threshold value Rth, there is possibility of occurrence of a false determination. Therefore, it is necessary to correct the pre-correction index quantity RIMB by a "value that indicates the responsiveness of the air/fuel ratio sensor 56", and to adopt the corrected value as an air/fuel ratio imbalance index value, and to accordingly perform the imbalance determination.

The first-embodiment determination apparatus acquires, as a value that indicates the responsiveness of the air/fuel ratio sensor 56, a correction-purpose output value (a correction-purpose output value before being corrected by the element's temperature) AveVaf that becomes greater the greater the "output value Vabyfs of the air/fuel ratio sensor 56 obtained during the fuel-cut operation" as a value that becomes greater the greater the output value Vabyfs of the air/fuel ratio sensor 56 obtained during the fuel-cut operation". A reason why the correction-purpose output value AveVaf shows the responsiveness of the air/fuel ratio sensor 56 will be explained below.

The limiting current value IL of the air/fuel ratio sensor 56 is expressed by the following expression (1) (basic expression). Incidentally, as mentioned above, the greater the limiting current value IL, the greater the output value Vabyfs.

Mathematical Expression 1

$$IL = \frac{4 \times F \times P}{R \times T} \times D \times \frac{S}{L} \times \ln\left(\frac{1}{1 - \frac{P_{O2}}{P}}\right) \quad (1)$$

In the expression (1), the symbols are given as follows.

F: Faraday constant

R: gas constant

T: absolute temperature of an element (element's temperature)

P: total exhaust gas temperature (exhaust gas pressure)

$P_{O2}$: oxygen partial pressure in exhaust gas

D: diffusion coefficient

S: diffusion resistance layer sectional area (a value equivalent to the area of the exhaust gas-side electrode layer 562)

L: diffusion distance (a value equivalent to the thickness of the diffusion resistance layer 564)

By the way, since the exhaust gas produced during the fuel cut operation is substantially the same gas as the atmosphere, the oxygen concentration in the exhaust gas during the fuel-cut operation is equal to the oxygen concentration in the atmosphere. Furthermore, since the oxygen concentration in the atmosphere can generally be considered constant, the value ($P_{O2}$/P) is constant (at a finite value smaller than 1) despite changes in the atmospheric pressure. Therefore, as can be understood from the expression (1), in the case where the atmospheric pressure is constant (i.e., the total exhaust gas pressure P during the fuel-cut operation is constant) and where the element's temperature T is constant, the limiting current value IL becomes smaller the greater the diffusion distance L. On the other hand, the responsiveness of the air/fuel ratio sensor 56 becomes higher the shorter the time needed for oxygen (and unburned substances) in the exhaust gas to diffuse through the diffusion resistance layer 564. That is, the smaller the diffusion distance L, the higher the responsiveness of the air/fuel ratio sensor 56.

Figure 11:
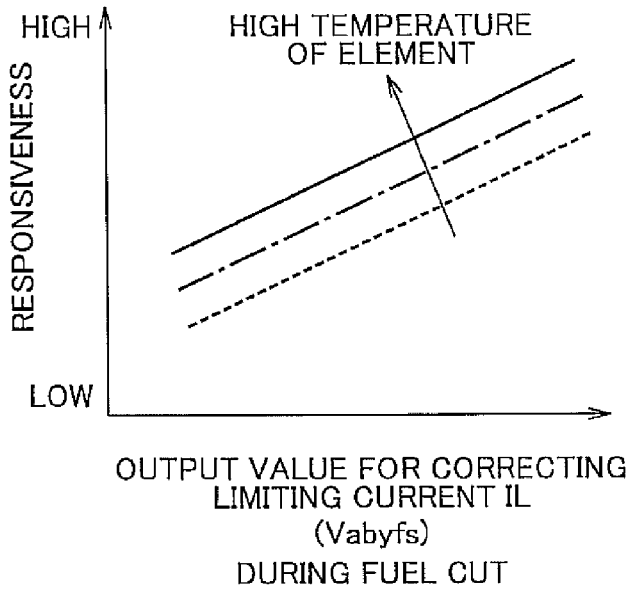
FIG. 11 is a graph showing a relation between the output value (limiting current value) of the air/fuel ratio sensor during a fuel-cut operation and the responsiveness of the air/fuel ratio sensor.

From the foregoing discussion, it can be understood that the output value Vabyfs of the air/fuel ratio sensor 56 which is equivalent to the limiting current value IL occurring during the fuel-cut operation has a strong correlation with the responsiveness of the air/fuel ratio sensor 56. That is, since the greater the limiting current value IL (output value Vabyfs) occurring during the fuel-cut operation, the shorter the diffusion distance L is considered to be, so that the higher the responsiveness of the air/fuel ratio sensor 56 becomes, as conceptually shown in FIG. 11.

From the foregoing discussion, it can be understood that the responsiveness of the air/fuel ratio sensor 56 is higher the greater "the correction-purpose output value AveVaf, which becomes greater the greater the limiting current value IL (output value Vabyfs) occurring during the fuel-cut operation".

Therefore, the first-embodiment determination apparatus calculates the correction-purpose output value AveVaf, and corrects the pre-correction index quantity RIMB on the basis of the correction-purpose output value AveVaf so that the pre-correction index quantity RIMB is smaller the greater the correction-purpose output value AveVaf (i.e., the higher the responsiveness of the air/fuel ratio sensor 56). Furthermore, the first-embodiment determination apparatus acquires this corrected value as an air/fuel ratio fluctuation index quantity AFD (i.e., an air/fuel ratio imbalance index value RIMBh for use for the imbalance determination).

As a result, it is possible to acquire the air/fuel ratio imbalance index value RIMBh that accurately shows the degree of non-uniformity of the cylinder-by-cylinder air/fuel ratios, regardless of the responsiveness of the air/fuel ratio sensor 56. Therefore, the imbalance determination can be accurately performed.

Incidentally, as can be understood from the expression (1), the higher the element's temperature T, the smaller the limiting current value IL. In other words, even if the responsiveness of the air/fuel ratio sensor 56 is constant, the limiting current value IL (output value Vabyfs) during the fuel-cut operation when the element's temperature T is high is smaller than the limiting current value IL (output value Vabyfs) during the fuel-cut operation when the element's temperature T is low. Hence, in the case where the limiting current value IL (output value Vabyfs) during the fuel-cut operation is a specific value, it can be said that the higher the element's temperature T, the higher the responsiveness of the air/fuel ratio sensor 56 is.

Therefore, the first-embodiment determination apparatus acquires as an element's temperature correlation value an average value of the element's temperature Temp of the air/fuel ratio sensor 56 occurring at the time of acquiring the correction-purpose output value AveVafh, and corrects the correction-purpose output value AveVaf so that the correction-purpose output value AveVaf becomes greater the higher the element's temperature correlation value, and thus acquires the final correction-purpose output value (the correction-purpose output value obtained by the correction based on the element's temperature) AveVafh. Then, the first-embodiment determination apparatus corrects the pre-correction index quantity RIMB on the basis of the final correction-purpose output value AveVafh as described above, so as to acquire an air/fuel ratio fluctuation index quantity AFD (i.e., an air/fuel ratio imbalance index value RIMBh for use for the imbalance determination).

Next, actual operations of the first-embodiment determination apparatus will be described.

Figure 12:
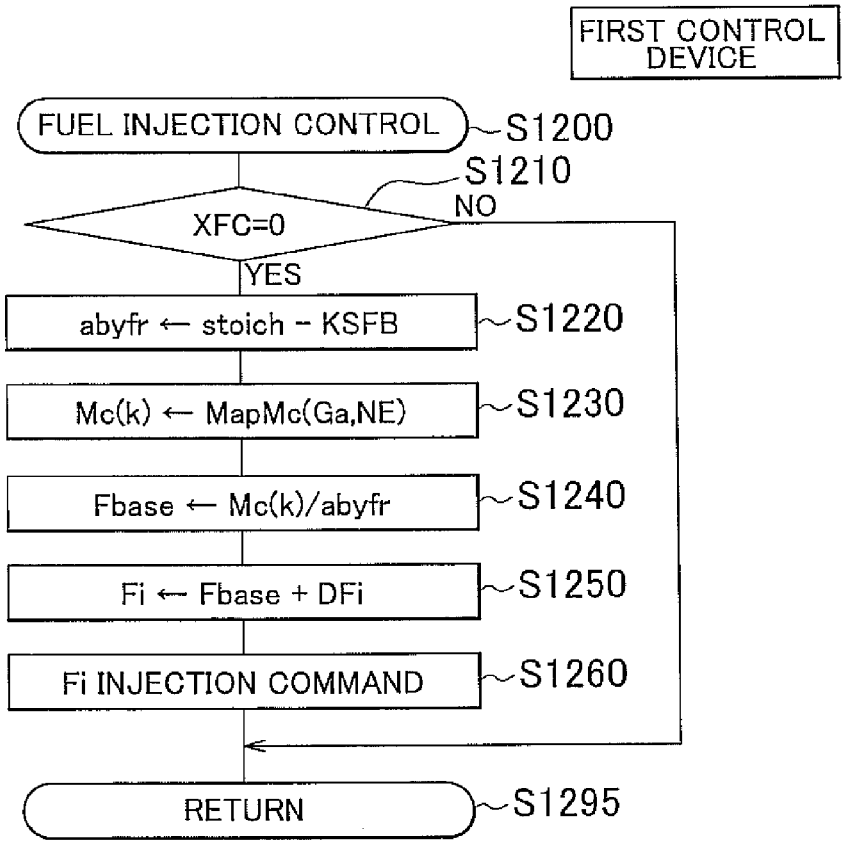
FIG. 12 is a flowchart showing a routine that is executed by a CPU of an inter-cylinder air/fuel ratio imbalance determination apparatus (first-embodiment determination apparatus) in accordance with a first embodiment of the invention.

The CPU of the first-embodiment determination apparatus repeats the execution of a fuel injection control routine shown in FIG. 12 on an arbitrary cylinder every time the crank angle of the cylinder becomes equal to a predetermined angle preceding the intake top dead center. The predetermined crank angle is, for example, BTDC 90° CA (90 crank angle [deg] prior to the intake top dead center). The cylinder whose crank angle is equal to the predetermined crank angle is referred to also as the "fuel injection cylinder". The CPU, by performing this fuel injection control routine, calculates the commanded fuel injection amount Fi and commands the fuel injection.

When the crank angle of an arbitrary cylinder becomes equal to the predetermined crank angle preceding the intake top dead center, the CPU starts the routine process at step 1200, and determines in step 1210 whether or not a fuel-cut flag XFC is "0". The value of fuel-cut flag XFC is set to "0" in an initial routine. Furthermore, the value of the fuel-cut flag XFC is set to "1" when the fuel-cut condition is satisfied, and is set to "0" when the fuel-cut condition is not satisfied. Incidentally, the initial routine is a routine that the CPU executes when the ignition key switch of the vehicle in which the engine 10 is mounted is changed from the off-state to the on-state.

The fuel-cut condition is satisfied, for example, when the throttle valve opening degree TA is "0" (the throttle valve 34 is completely closed) and the engine rotation speed NE is higher than or equal to a fuel-cut rotation speed NEth, after the fuel-cut condition has been determined as not being satisfied.

The fuel-cut condition is unsatisfied, for example, when the throttle valve opening degree Ta becomes unequal to "0" (the throttle valve 34 becomes not completely closed) or the engine rotation speed becomes less than a fuel-cut return rotation speed NErth, after the fuel-cut condition has been determined as being satisfied. The fuel-cut return rotation speed NErth is a rotation speed that is less than the fuel-cut rotation speed NEth by a predetermined positive rotation speed.

It is assumed herein that the fuel-cut condition is not satisfied and therefore the value of the fuel-cut flag XFC is "0". In this case, the CPU makes an affirmative determination (XFC=0) in step 1210, and sequentially performs the processes of steps 1220 to 1260 described below, and proceeds to step 1295, in which the CPU ends the present execution of this routine.

Step 1220: The CPU sets a target air/fuel ratio abyfr to a value obtained by subtracting a subsidiary feedback amount KSFB from the stoichiometric air/fuel ratio stoich. The subsidiary feedback amount KSFB is obtained separately in a routine described below with reference to FIG. 14.

Step 1230: The CPU acquires an "in-cylinder intake air amount Mc(k)" that is an "amount of air taken into a fuel injection cylinder during one intake stroke of the fuel injection cylinder" on the basis of "the intake air amount Ga measured by the air flow meter 51, the engine rotation speed NE acquired on the basis of the signal from the crank position sensor 54, and the backup table MapMc". The in-cylinder intake air amount Mc(k) is stored into the RAM in correspondence to each intake stroke. The in-cylinder intake air amount Mc(k) may also be calculated in a well-known air amount estimation model (a model that is constructed according to physical laws simulating the behavior of air in the intake passageway).

Step 1240: The CPU obtains a basic fuel injection amount Fbase by dividing the in-cylinder intake air amount Mc(k) by the target air/fuel ratio abyfr. Therefore, the basic fuel injection amount Fbase is a feed-forward amount of the fuel injection amount that is needed in calculation in order to cause the air/fuel ratio of the engine (therefore the air/fuel ratio of the exhaust gas that flows into the upstream-side catalyst 43) to equal the target air/fuel ratio abyfr. This step 1240 constitutes a feed-forward control device (basic fuel injection amount calculation device) for causing the air/fuel ratio of a mixture supplied to the engine to equal the target air/fuel ratio abyfr.

Step 1250: The CPU corrects the basis fuel injection amount Fbase by a main feedback amount DFi. More concretely, the CPU calculates a commanded fuel injection amount (final fuel injection amount) Fi by adding a main feedback amount DFi to the basic fuel injection amount Fbase. The main feedback amount DFi is an air/fuel ratio feedback amount for causing the air/fuel ratio of the engine to equal the target air/fuel ratio abyfr, and is obtained on the basis of the output value Vabyfs of the air/fuel ratio sensor 56. The calculation method for the main feedback amount DFi will be described later.

Step 1260: The CPU sends out a fuel command signal for injecting the "commanded fuel injection amount Fi of fuel" from a "fuel injection valve 33 provided in correspondence to the fuel injection cylinder" to the fuel injection valve 33.

As a result, the amount of fuel that is needed (considered to be needed) in terms of calculation in order to cause the air/fuel ratio of the engine to equal to the target air/fuel ratio abyfr is injected from the fuel injection valve 33 of the fuel injection cylinder. That is, steps 1230 to 1260 constitute a commanded fuel injection amount control device that controls the commanded fuel injection amount Fi so that the "air/fuel ratio of a mixture supplied into the combustion chamber 21 of each of two or more of cylinders (all the cylinders in this embodiment) that are discharging exhaust gas that reaches the air/fuel ratio sensor 56" becomes equal to the target air/fuel ratio abyfr.

On the other hand, if the value of the fuel-cut flag XFC has been set at "1" at the time point when the CPU executes the process of step 1210, the CPU makes a negative determination (XFC≠0) in step 1210, and directly proceeds to step 1295, in which the CPU ends the present execution of this routine. In this case, since the fuel injection by the process of step 1260 is not executed, the fuel-cut operation (fuel supply stop control) is executed.

<CALCULATION OF MAIN FEEDBACK AMOUNT>

Figure 13:
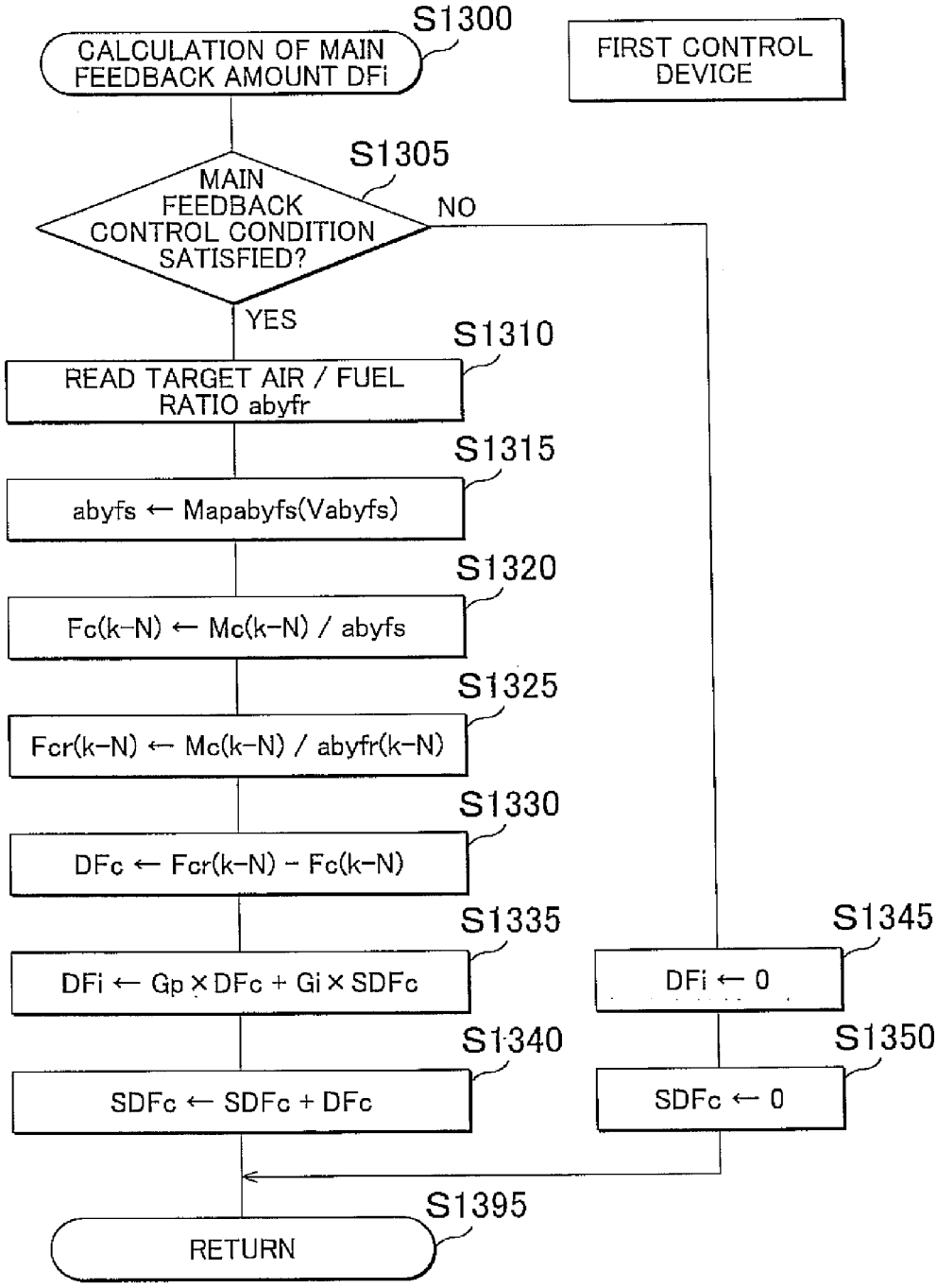
FIG. 13 is a flowchart showing a routine that is executed by the CPU of the first-embodiment determination apparatus.

The CPU repeats the execution of a "main feedback amount calculation routine" shown by a flowchart in FIG. 13 at every elapse of a predetermined time. Therefore, when a predetermined timing arrives, the CPU starts the routine process at step 1300, and proceeds to step 1305, in which the CPU determines whether or not a "main feedback control condition (upstream-side air/fuel ratio feedback control condition)" is satisfied.

The main feedback control condition is satisfied when all the following conditions are satisfied. (A1) The air/fuel ratio sensor 56 is active. (A2) The load KL of the engine is less than or equal to a threshold value KLth. (A3) The fuel-cut control is not being performed (the fuel-cut flag XFC is "0").

Incidentally, the load KL is a load factor determined by the following expression (2). In place of the load KL, an accelerator pedal operation amount Accp may be used. In the expression (2), Mc is the in-cylinder intake air amount, ρ is the density of air (whose unit is g/l), L is the displacement of the engine 10 (whose unit is liter), and "4" is the number of cylinders of the engine 10.

$$KL=(Mc/(\rho\times L/4))\times 100\% \quad (2)$$

The description will be continued with the assumption that the main feedback control condition is satisfied. In this case, the CPU makes an affirmative determination (determines that the main feedback control condition is satisfied) in step 1305, and then sequentially performs the processes of steps 1310 to 1340, and then proceeds to step 1395, in which the CPU ends the present execution of this routine.

Step 1310: The CPU reads in the "target air/fuel ratio abyfr (k−N) that is used number N cycles before" which is calculated in step 1220 and stored in the RAM.

Step 1315: The CPU obtains a detected air/fuel ratio abyfs by applying the output value Vabyfs of the air/fuel ratio sensor 56 to the table Mapabyfs shown in FIG. 6, as shown in the following expression (3).

$$abyfs=Mapabyfs(Vabyfs) \quad (3)$$

Step 1320: The CPU obtains an "in-cylinder supplied fuel amount Fc(k−N)", which is an "amount of fuel that is actually supplied into a combustion chamber 21 at the time point of N number of cycles prior to the present time point" according to the following expression (4). That is, the CPU obtains the in-cylinder supplied fuel amount Fc(k−N) by dividing the "in-cylinder intake air amount Mc(k−N) at the time point of N number of cycles (i.e., N×720 crank angle [deg]) prior to the present time point" by the "detected air/fuel ratio abyfs".

$$Fc(k-N)=Mc(k-N)/abyfs \quad (4)$$

A reason why the in-cylinder intake air amount Mc(k−N) occurring N number of cycles prior to the present time point is divided by the detected air/fuel ratio abyfs in order to obtain the in-cylinder supplied fuel amount Fc(k−N) is that an amount of time that is equivalent to the N number of cycles is required before the "exhaust gas generated by the combustion of mixture in combustion chambers 21" reaches the air/fuel ratio sensor 56.

Step 1325: The CPU obtains a "target in-cylinder supplied fuel amount Fcr(k−N)" that is an "amount of fuel that needs to be supplied into the combustion chamber 21 at the time point of N number of cycles prior to the present time point", according to the expression (5). That is, the CPU obtains the target in-cylinder supplied fuel amount Fcr(k−N) by dividing the in-cylinder intake air amount Mc(k−N) at the time point of N number of cycles prior to the present time point by the target air/fuel ratio abyfr(k−N) used N number of cycles prior to the present time point.

$$Fcr(k-N)=Mc(k-N)/abyfr(k-N) \quad (5)$$

Step 1330: The CPU acquires an in-cylinder supplied fuel amount deviation DFc according to the following expression (6). That is, the CPU obtains the in-cylinder supplied fuel amount deviation DFc by subtracting the in-cylinder supplied fuel amount Fc(k−N) from the target in-cylinder supplied fuel amount Fcr(k−N). This in-cylinder supplied fuel amount deviation DFc is a quantity that represents the shortfall or excess, by which the amount of fuel supplied into the cylinder at the time point of N number of strokes before is short of or exceeds an appropriate amount.

$$DFc=Fcr(k-N)-Fc(k-N) \quad (6)$$

Step 1335: The CPU obtains a main feedback amount DFi according to the following expression (7). In this expression (7), Gp is a pre-set proportional gain, and Gi is a pre-set integral gain. Furthermore, the "value SDFc" is an "integrated value of the in-cylinder supplied fuel amount deviation DFc". That is, the CPU calculates the "main feedback amount DFi" by a proportional-plus-integral control for causing the detected air/fuel ratio abyfs to equal the target air/fuel ratio abyfr.

$$DFi=GpxDFc+GixSDFc \quad (7)$$

In step 1340, the CPU acquires a new integrated value SDFc of the in-cylinder supplied fuel amount deviation by adding the in-cylinder supplied fuel amount deviation DFc obtained in step 1330 to the integrated value SDFc of the in-cylinder supplied fuel amount deviation DFc that is obtained at that time point.

Due to the above-described processes, the main feedback amount DFi is calculated by the proportional-plus-integral control, and the main feedback amount DFi is reflected in the commanded fuel injection amount Fi by the above-described process of step 1250 in FIG. 12.

On the other hand, if the main feedback control condition is not satisfied at the time of determination in step 1305 in FIG. 13, the CPU makes a negative determination in step 1305 (determines that the main feedback control condition is not satisfied), and then proceeds to step 1345, in which the CPU sets the value of the main feedback amount DFi to "0". Subsequently in step 1350, the CPU stores "0" as the integrated value SDFc of the in-cylinder supplied fuel amount deviation. After that, the CPU proceeds to step 1395, in which the CPU ends the present execution of this routine. Thus, when the main feedback control condition is not satisfied, the main feedback amount DFi is set to "0". Therefore, the correction based on the main feedback amount DFi of the basic fuel injection amount Fbase is not performed.

Figure 14:
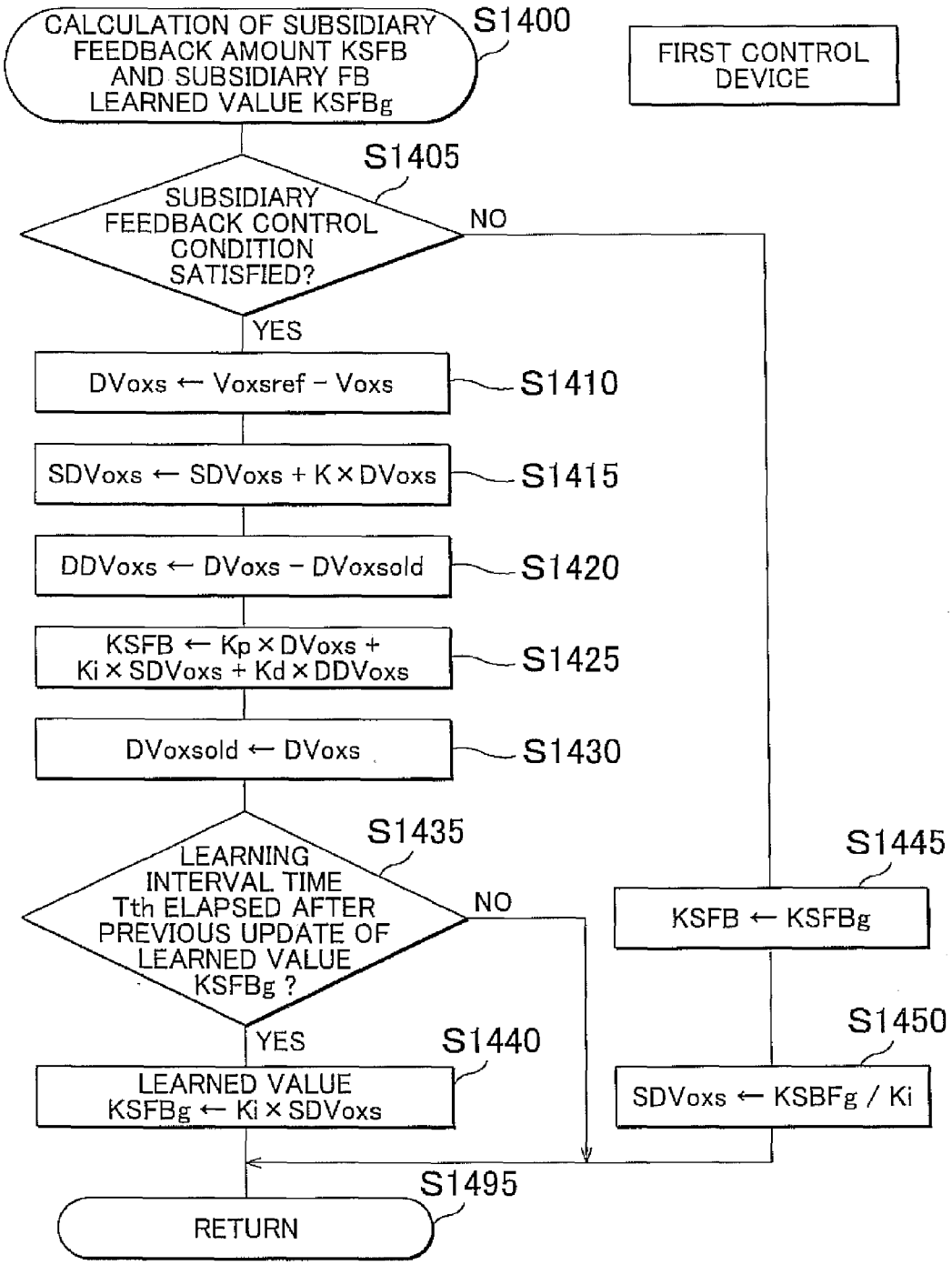
FIG. 14 is a flowchart showing a routine that is executed by the CPU of the first-embodiment determination apparatus.

<CALCULATION OF SUBSIDIARY FEEDBACK AMOUNT KSFB AND SUBSIDIARY FEEDBACK LEARNED VALUE KSFBg> The CPU repeats the execution of "a calculation routine for a subsidiary feedback amount KSFB and a subsidiary feedback learned value KSFBg" that is shown by a flowchart in FIG. 14 at every elapse of a predetermined time. Therefore, when a predetermined timing arrives, the CPU starts the routine process at step 1400, and proceeds to step 1405, in which the CPU determines whether or not a subsidiary feedback control condition is satisfied.

The subsidiary feedback control condition is satisfied when all the following conditions are satisfied. (B1) The main feedback control condition is satisfied. (B2) The downstream-side oxygen concentration sensor 57 is active.

The description will be continued with an assumption that the subsidiary feedback control condition is satisfied. In this case, the CPU makes an affirmative determination in step 1405 (determines that the subsidiary feedback control condition is satisfied), and executes the processes of steps 1410 to 1430 (the subsidiary feedback amount calculation process), and then proceeds to step 1435.

Step 1410: The CPU acquires an "output deviation amount DVoxs" that is a difference between a "downstream-side target value Voxsref" and an "output value Voxs of the downstream-side oxygen concentration sensor 57" according to the following expression (8). The downstream-side target value Voxsref has been set to a value that is equivalent to a value that corresponds to a reference air/fuel ratio abyfr0 within the window of the three-way catalyst 43 (e.g., the stoichiometric air/fuel ratio). That is, the CPU obtains an "output deviation amount DVoxs" by subtracting the "output value Voxs of the downstream-side oxygen concentration sensor 57 at the present time point" from the "downstream-side target value Voxsref".

$$DVoxs=Voxsref-Voxs \quad (8)$$

Step 1415: The CPU obtains a new integrated value SDVoxs (=SDVoxs(n)) of the output deviation amount by adding the "product of multiplication of a gain K and the output deviation amount DVoxs obtained in step 1410" to the "integrated value SDVoxs (=SDVoxs(n−1)) of the output deviation amount at that time point" according to the following expression (9). Incidentally, the gain K is set at "1" in this embodiment. The integrated value SDVoxs is also referred to as "time-integrated value SDVoxs or integration-processed value SDVoxs".

$$SDVoxs(n)=SDVoxs(n-1)+K\times DVoxs \quad (9)$$

Step 1420: The CPU obtains a new differential value DDVoxs of the output deviation amount by subtracting the "previous output deviation amount DVoxsold that is the output deviation amount calculated during the previous execution of the routine" from the "output deviation amount DVoxs calculated in step 1410".

Step 1425: The CPU obtains the subsidiary feedback amount KSFB according to the following expression (10). In the expression (10), Kp is a pre-set proportional gain (proportionality constant), Ki is a pre-set integral gain (integration constant), and Kd is a pre-set derivative gain (differential constant). That is, Kp×DVoxs is a proportional term, Ki×SDVoxs is an integral term, and Kd×DDVoxs is a differential term. The integral term Ki×SDVoxs is also a steady component of the subsidiary feedback amount KSFB.

$$KSFB=Kp\times DVoxs+Ki\times SDVoxs+Kd\times DDVoxs \quad (10)$$

Step 1430: The CPU stores the "output deviation amount DVoxs calculated in step 1410" as the "previous output deviation amount DVoxsold".

In this manner, the CPU calculates the "subsidiary feedback amount KSFB" by the proportional-integral-derivative (PID) control for causing the output value Voxs of the downstream-side oxygen concentration sensor 57 to equal the downstream-side target value Voxsref. This subsidiary feedback amount KSFB is used to calculate the target air/fuel ratio abyfr (abyfr=stoich−KSFB) as described above.

That is, when the output value Voxs is smaller than the downstream-side target value Voxsref (is on the lean side), the subsidiary feedback amount KSFB gradually increases. As the subsidiary feedback amount KSFB increases, the target air/fuel ratio abyfr is corrected so as to lessen (become a richer-side air/fuel ratio). In consequence, since the true average air/fuel ratio of the engine 10 lessens (becomes a richer-side air/fuel ratio), the output value Voxs increases so as to equal the downstream-side target value Voxsref.

On the other hand, when the output value Voxs is larger than the downstream-side target value Voxsref (is on the rich side), the subsidiary feedback amount KSFB gradually lessens. As the subsidiary feedback amount KSFB lessens, the target air/fuel ratio abyfr is corrected so as to increase (become a leaner-side air/fuel ratio). In consequence, since the true average air/fuel ratio of the engine 10 increases (becomes a leaner-side air/fuel ratio), the output value Voxs decreases so as to equal the downstream-side target value Voxsref.

After step 1430, the CPU determines whether or not a learning interval time Tth has elapsed following the time point of the previous update of the learned value KSFBg of the subsidiary feedback amount (subsidiary feedback learned value KSFBg). If the learning interval time Tth has not elapsed following the time point of the previous update of the subsidiary feedback learned value KSFBg, the CPU makes a negative determination in step 1435, and directly proceeds to step 1495, in which the CPU ends the present execution of this routine.

On other hand, if at the time point at which the CPU executes the process of step 1435, the learning interval time Tth has elapsed following the time point of the previous update of the subsidiary feedback learned value KSFBg, the CPU makes an affirmative determination in step 1435, and proceeds to step 1440. In step 1440, the CPU stores the product of multiplication of the integrated value SDVoxs and the integral gain Ki (Ki×SDVoxs) into the backup RAM as a subsidiary feedback learned value KSFBg. After that, the CPU proceeds to step 1495, in which the present execution of this routine is ended.

Thus, the CPU takes up as the subsidiary feedback learned value KSFBg the steady term Ki×SDVoxs of the subsidiary feedback amount KSFB at the time point of elapse of a period that is longer than the period of the update of the feedback amount KSFB (i.e., elapse of the learning interval time Tth).

Incidentally, the CPU may also acquire as the subsidiary feedback learned value KSFBg a value obtained by the low-pass filter process of the integral term (steady term) Ki×SDVoxs. Furthermore, the CPU may also acquire as the subsidiary feedback leaned value KSFBg a value obtained by the low-pass filter process of the subsidiary feedback amount KSFB. That is, it suffices that the subsidiary feedback learned value KSFBg is a value commensurate with the steady component of the subsidiary amount KSFB.

On the other hand, if the subsidiary feedback control condition is not satisfied at the time point at which the CPU executes the process of step 1405, the CPU makes a negative determination in step 1405, and proceeds to step 1445. In step 1445, the CPU sets the subsidiary feedback learned value KSFBg as the subsidiary feedback amount KSFB. That is, the CPU stops updating the subsidiary feedback amount KSFB. Subsequently in step 1450, the CPU stores as the integrated value SDVoxs a value obtained by dividing the subsidiary feedback learned value KSFBg by the integral gain Ki (i.e., (subsidiary feedback learned value KSFBg)/(integral gain Ki)), into the backup RAM. After that, the CPU proceeds to step 1495, in which the CPU ends the present execution of this routine.

Incidentally, the first-embodiment determination apparatus may also be realized in a such manner that the subsidiary feedback control that uses the subsidiary feedback amount is not executed. In this case, the routine shown in FIG. 14 is omitted. Furthermore, the subsidiary feedback amount KSFB for use in the other routines is substituted with "0".

Next, a process for acquiring the air/fuel ratio imbalance index value will be described. The CPU executes a routine shown by a flowchart shown in FIG. 15, every time 4 ms (i.e., a "predetermined constant sampling time ts" that is the aforementioned unit time) elapses.

Therefore, when a predetermined timing arrives, the CPU starts the routine process at step 1500, and proceeds to step 1505, in which the CPU determines whether or not the value of a parameter acquisition permission flag Xkyoka is "1".

The value of the parameter acquisition permission flag Xkyoka is set to "1" when a parameter acquisition condition (air/fuel ratio imbalance index value acquisition permission condition) (described later) is satisfied, and is immediately set to "0" at the time point when the parameter acquisition permission condition becomes unsatisfied.

The parameter acquisition condition is satisfied when all the following conditions (conditions C1 to C5) are satisfied. Therefore, the parameter acquisition condition is not satisfied if any one of the following conditions (conditions C1 to C5) is unsatisfied. Of course, the conditions that constitute the parameter acquisition condition are not limited to the conditions C1 to C5 listed below.

(Condition C1) The intake air amount Ga acquired by the air flow meter 51 is in a predetermined range. That is, the intake air amount Ga is greater than or equal to a lower-side threshold air amount GaLoth, and is less than or equal to a higher-side threshold air amount GaHith. (Condition C2) The engine rotation speed NE is in a predetermined range. That is, the engine rotation speed NE is greater than or equal to the lower-side threshold rotation speed NELoth, and is less than or equal to a higher-side threshold rotation speed NEHith. (Condition C3) The cooling liquid temperature THW is higher than or equal to a threshold cooling liquid temperature THWth. (Condition C4) Both the main feedback control condition and the subsidiary feedback control condition are satisfied. (Condition C5) The fuel-cut control is not being executed (the fuel-cut flag XFC is "0").

Let it assumed that the value of the parameter acquisition permission flag Xkyoka is "1". In this case, the CPU makes an affirmative determination in step 1505 (Xkyoka=1), and proceeds to step 1510, in which the CPU acquires the "output value Vabyfs of the air/fuel ratio sensor 56 given at that time point". Incidentally, prior to the process of step 1510, the CPU stores the output value Vabyfs acquired during the previous execution of the routine as the previous output value Vabyfsold. That is, the previous output value Vabyfsold is an output value Vabyfs that is obtained at the time point that is 4 ms (the sampling time ts) prior to the present time point. The initial value of the previous output value Vabyfs is set at a value that is equivalent to the stoichiometric air/fuel ratio in the above-described initial routine.

Next, the CPU proceeds to step 1515, in which the CPU (A) acquires a rate of change ΔAF (differential value d(Vabyfs)/dt) of the output value Vabyfs, (B) updates the accumulated value SAFD of the absolute value |ΔAF| of the rate of change ΔAF, and (C) updates the value of a number-of-accumulations counter (i.e. a total number counter) Cn that counts the number of times that the absolute value |ΔAF| of the rate of change ΔAF has been added to the accumulated value SAFD. The method for this update will be concretely described below.

(A) ACQUISITION OF RATE OF CHANGE ΔAF.

The rate of change ΔAF (differential value d(Vabyfs)/dt) of the output value Vabyfs is a piece of data (a basic index quantity, a basic parameter) that serves as source data of the pre-correction index quantity RIMB (therefore, the air/fuel ratio imbalance index quantity RIMBh). The CPU acquires the rate of change ΔAF by subtracting the previous output value Vabyfsold from the present output value Vabyfs. That is, the CPU obtains the "present rate of change ΔAF(n)" in step 1515, according to the following expression (11) where Vabyfs(n) represents the present output value Vabyfs, and Vabyfs(n−1) represents the previous output value Vabyfsold.

$$\Delta AF(n)=Vabyfs(n)-Vabyfs(n-1) \tag{11}$$

Incidentally, in order to eliminate the fluctuating component of the center air/fuel ratio of the engine 10 that is contained in the output value Vabyfs of the air/fuel ratio sensor 56, the CPU may obtain a value obtained by subjecting the output value Vabyfs to a high-pass filter process (a post-high-pass-filter-process output value VHPF), and may acquire the amount of change in the post-high-pass-filter-process output value VHPF in a sampling time ts, as a rate of change ΔAF.

(B) UPDATE OF ACCUMULATED VALUE SAFD OF ABSOLUTE VALUES |ΔAF| OF RATE OF CHANGE ΔAF.

The CPU obtains the present accumulated value SAFD(n) according to the following expression (12). That is, the CPU updates the accumulated value SAFD by adding the present absolute value |ΔAF(n)| of the rate of change ΔAF(n) calculated as described above to the previous accumulated value SAFD(n−1) at the time point at which the CPU proceeds to step 1515.

$$SAFD(n)=SAFD(n-1)+|\Delta AF(n)| \tag{12}$$

Figure 8C:
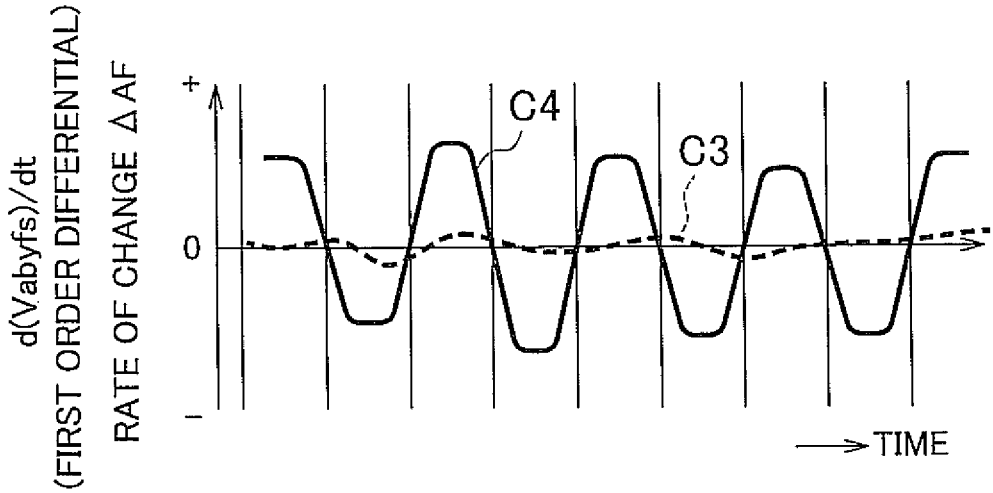

A reason why the absolute value of the present rate of change ΔAF(n) is added is that the rate of change ΔAF(n) can be positive as well as negative, as can be understood from FIG. 8B and FIG. 8C. Incidentally, the accumulated value SAFD is also set to "0" in the above-described initial routine.

(C) UPDATE OF NUMBER-OF-ACCUMULATIONS COUNTER Cn OF NUMBER OF TIMES THAT ABSOLUTE VALUE |ΔAF| OF RATE OF CHANGE HAS BEEN ADDED TO ACCUMULATED VALUE SAFD.

The CPU increments the value of the counter Cn by "1" according to the following expression (13). In the expression (13), Cn(n) is a post-update value of the counter Cn, and Cn(n−1) is a pre-update value of the counter Cn. The value of the counter Cn is set to "0" in the aforementioned initial routine, and is set to "0" in step 1545 and step 1550 (both will be described below) as well. Therefore, the value of the counter Cn shows the number of the pieces of data of the absolute value |ΔAF| of the rate of change ΔAF that have been accumulated into the accumulated value SAFD.

$$Cn(n)=Cn(n-1)+1 \tag{13}$$

Next, the CPU proceeds to step 1520, in which the CPU determines whether or not the crank angle CA with reference to the compression top dead center of a reference cylinder (the first cylinder in this embodiment) (i.e., the absolute crank angle CA) is 720 crank angle [deg]. If at this time, the absolute crank angle CA is less than 720 crank angle [deg], the CPU makes a negative determination in step 1520, and directly proceeds to step 1595, in which the CPU ends the present execution of this routine.

Incidentally, step 1520 is a step of determining a minimum-unit period for obtaining an average value of the absolute value |ΔAF| of the rate of change ΔAF. In this embodiment, the minimum period corresponds to "720 crank angle [deg], which is a unit combustion cycle period". Of course, this minimum period may be shorter than 720 crank angle [deg]. However, it is desirable that the minimum period be longer than or equal to two or more times the sampling time ts. Furthermore, it is desirable that the minimum period be a period equal to the multiplication product of the unit combustion cycle period by a natural number.

On the other hand, if the absolute crank angle CA is 720 crank angle [deg] at the time point at which the CPU performs the process of step 1520, the CPU makes an affirmative determination in step 1520, and proceeds to step 1525.

In step 1525, the CPU (D) calculates an average value AveΔAF of the absolute value |ΔAF| of the rate of change ΔAF, (E) updates the accumulated value Save of the average value AveΔAF, and (F) updates the value of the number-of-accumulations counter Cs. The update methods for these values will be described below.

(D) CALCULATION OF AVERAGE VALUE AveΔAF OF ABSOLUTE VALUE |ΔAF| OF RATE OF CHANGE ΔAF.

The CPU calculates the average value AveΔAF of the absolute value |ΔAF| of the rate of change ΔAF by dividing the accumulated value SAFD by the value of the counter Cn as shown in the following expression (14). After that, the CPU sets the accumulated value SAFD and the value of the counter Cn to "0".

$$\text{Ave}\Delta AF=SAFD/Cn \tag{14}$$

(E) UPDATE OF ACCUMULATED VALUE Save OF AVERAGE VALUE AveΔAF.

The CPU obtains the present accumulated value Save(n) according to the following expression (15). That is, the CPU updates the accumulated value Save by adding the present average value AveΔAF calculated as described above to the previous accumulated value Save(n−1) at the time point at which the CPU proceeds to step 1525. The accumulated value Save(n) is set to "0" in the aforementioned initial routine, and is also set to "0" in step 1545 (described below).

$$\mathrm{Save}(n)=\mathrm{Save}(n-1)+\mathrm{Ave}\Delta AF \tag{15}$$

(F) UPDATE OF NUMBER-OF-ACCUMULATIONS COUNTER Cs.

The CPU increments the value of the counter Cs by "1" according to the following expression (16). In the expression (16), Cs(n) is a post-update value of the counter Cs, and Cs(n−1) is a pre-update value of the counter Cs. This value of the counter Cs is set to "0" in the aforementioned initial routine, and is also set to "0" step 1545 (described below). Therefore, the value of the counter Cs shows the number of the pieces of data of average value AveΔAF that have been accumulated into the accumulated value Save.

$$Cs(n)=Cs(n-1)+1 \tag{16}$$

Next, the CPU proceeds to step 1530, in which the CPU determines whether or not the value of the counter Cs is greater than or equal to a threshold value Csth. If the value of the counter Cs is less than the threshold value Csth, the CPU makes a negative determination in step 1530, and directly proceeds to step 1595, in which the CPU ends the present execution of this routine. Incidentally, the threshold value Csth is a natural number, and is desirably two or more.

On the other hand, if the value of the counter Cs is greater than or equal to the threshold value Csth at the time point at which the CPU performs the process of step 1530, the CPU makes an affirmative determination in step 1530, and proceeds to step 1535. In step 1535, the CPU acquires a pre-correction index quantity RIMB (an air/fuel ratio imbalance index value RIMB prior to correction by the responsiveness of the air/fuel ratio sensor 56) by dividing the accumulated value Save by the value of the counter Cs (=Csth) according to the following expression (17). The pre-correction index quantity RIMB is obtained by averaging the average values AveΔAF of the absolute values |ΔAF| of the rates of change ΔAF (differential values d(Vabyfs)/dt) in unit combustion cycle periods, with respect to a plurality (Csth number) of unit combustion cycle periods.

$$RIMB=\mathrm{Save}/Csth \tag{17}$$

Next, the CPU proceeds to step 1540, in which the CPU sets the value of an imbalance determination feasibility flag Xhantei to "1". The value of the imbalance determination feasibility flag Xhantei is set to "0" in the aforementioned initial routine. Therefore, the value of the imbalance determination feasibility flag Xhantei is set to "1" when the pre-correction index quantity RIMB is acquired after the engine 10 is started.

Next, the CPU proceeds to step 1545, in which the CPU sets (clears) "various values (ΔAF, SAFD, Cn, AveΔAF, Save, Cs, etc.) for use for calculating the pre-correction index quantity RIMB" to "0". After that, the CPU proceeds to step 1595, in which the CPU ends the present execution of this routine.

On other hand, if the value of the parameter acquisition permission flag Xkyoka is not "1" when the CPU proceeds to step 1505, the CPU makes a negative determination in step 1505, and proceeds to step 1550. In step 1550, the CPU sets (clears) the "various values (ΔAF, SAFD, Cn, etc.) for use for calculating the average value AveΔAF" to "0". Next, the CPU proceeds to step 1595, in which the CPU ends the present execution of this routine.

Next, a routine for determining whether or not an inter-cylinder air/fuel ratio imbalance state has occurred will be described. The CPU executes an imbalance determination routine shown by a flowchart in FIG. 16 every time a predetermined time elapses. Therefore, when a predetermined timing arrives, the CPU starts the routine process at step 1600 in FIG. 16, and proceeds to step 1605, in which the CPU determines whether or not the value of the fuel-cut flag XFC is "0". If at this time, the value of the fuel-cut flag XFC is "1" (i.e., if the fuel-cut is being executed), the CPU makes a negative determination in step 1605, and proceeds to step 1695, in which the CPU ends the present execution of this routine.

On the other hand, if the value of the fuel-cut flag XFC is "0" at the time at which the CPU executes the process of step 1605, the CPU proceeds to step 1610, in which the CPU determines whether or not the value of an imbalance determination completion flag XFIN is "0".

The value of the imbalance determination completion flag XFIN is set to "0" in the aforementioned initial routine. Furthermore, the value of the imbalance determination completion flag XFIN is set to "1" when the imbalance determination is completed (see step 1660 (described below)). If the value of the imbalance determination completion flag XFIN is "1", the CPU makes a negative determination in step 1610, and directly proceeds to step 1695, in which the CPU ends the present execution of this routine. Therefore, the imbalance determination is not executed.

Let it assumed that the imbalance determination has not been executed following the starting of the engine 10. In this case, since the value of the imbalance determination completion flag XFIN is "0", the CPU makes an affirmative determination in step 1610, and proceeds to step 1615. In step 1615, the CPU determines whether or not the value of the imbalance determination feasibility flag Xhantei is "1". At this time, if the value of the imbalance determination feasibility flag Xhantei is "0" (i.e., if the pre-correction index quantity RIMB has not been acquired following the starting of the engine 10, as mentioned above), the CPU makes a negative determination in step 1615, and directly proceeds to step 1695, in which the CPU ends the present execution of this routine. Therefore, the imbalance determination is not executed.

Figure 15:
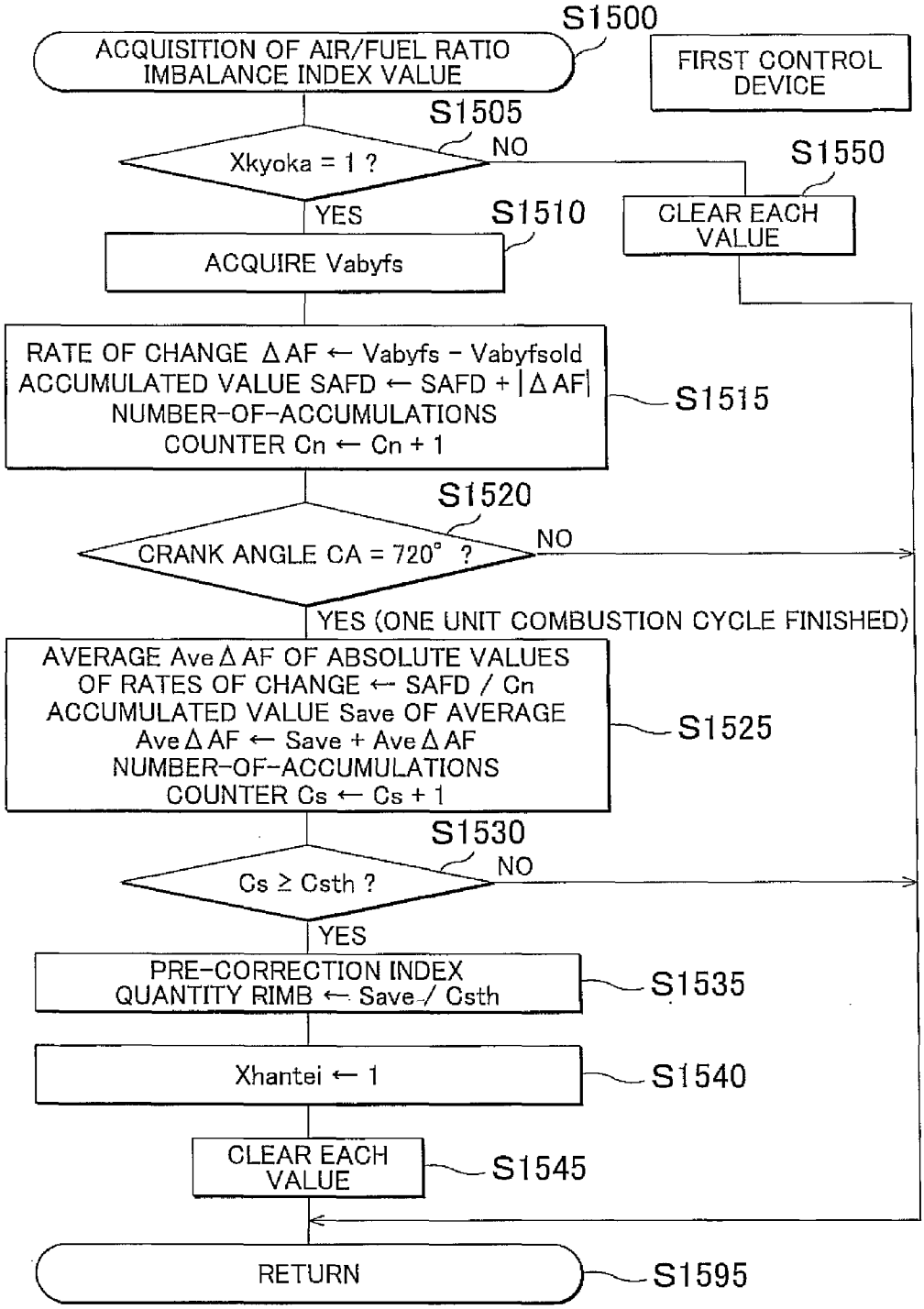
FIG. 15 is a flowchart showing a routine that is executed by the CPU Of the first-embodiment determination apparatus.
Figure 16:
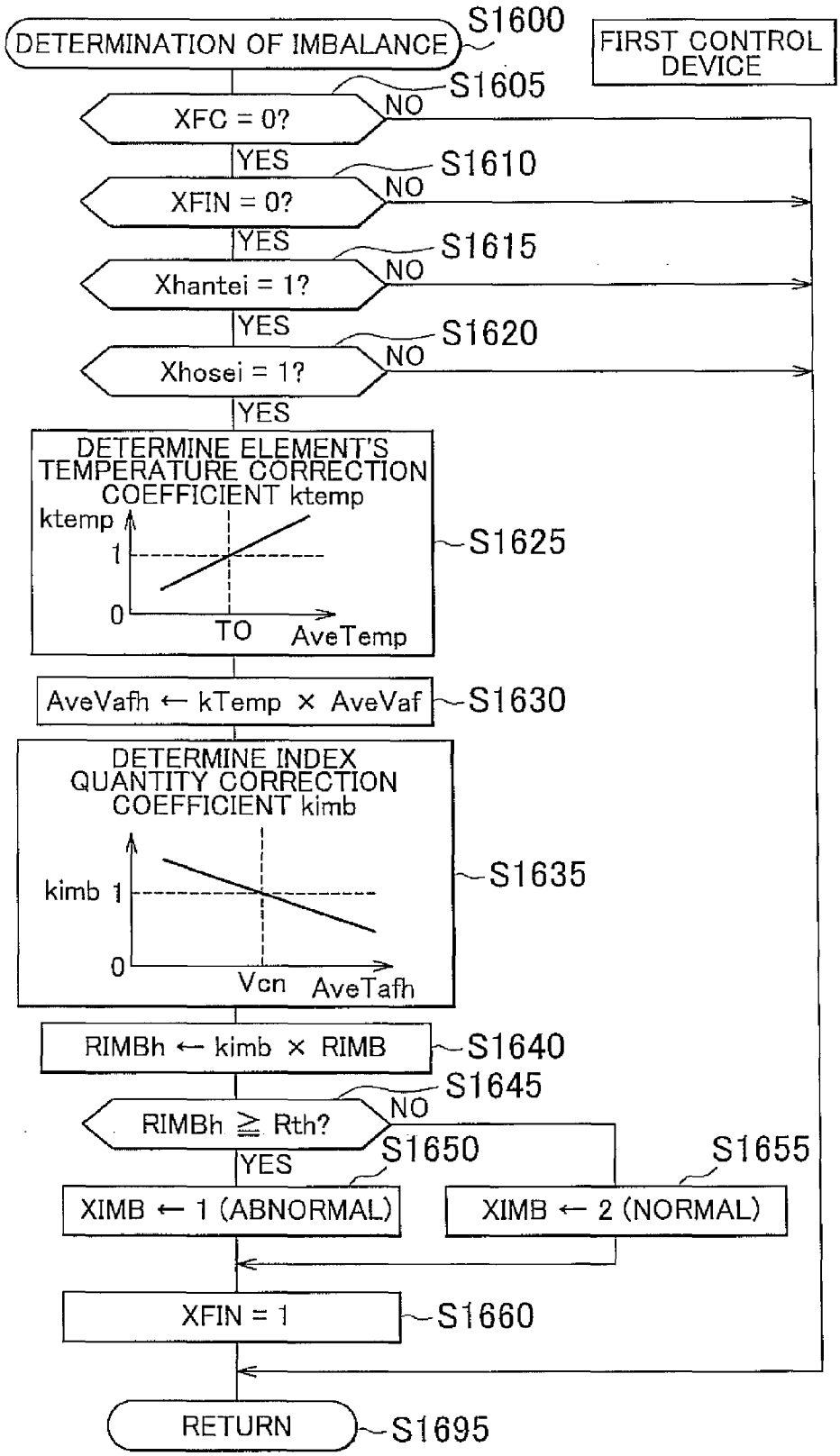
FIG. 16 is a flowchart showing a routine that is executed by the CPU of the first-embodiment determination apparatus.

On the other hand, if the pre-correction index quantity RIMB is acquired by the process of step 1535 in FIG. 15 and the value of the imbalance determination feasibility flag Xhantei is set to "1" by the process of step 1540 in FIG. 15, the CPU makes an affirmative determination in step 1615 in FIG. 16, and proceeds to step 1620. In step 1620, the CPU determines whether or not the value of a correction feasibility flag Xhosei is "1".

The value of the correction feasibility flag Xhosei is set to "0" in the aforementioned initial routine. Furthermore, the value of the correction feasibility flag Xhosei is set to "1" when a "correction-purpose output value AveVaf and an element's temperature correlation value AveTemp" are acquired by routines shown in FIG. 17 and FIG. 18 (described below) (see step 1855 in FIG. 18).

Let it assumed that the value of the correction feasibility flag Xhosei is "0". In this case, the CPU makes a negative determination in step 1620, and directly proceeds to step 1695, in which the CPU ends the present execution of this routine. Therefore, the imbalance determination is not executed.

On the other hand, if the value of the correction feasibility flag Xhosei is "1" at the time point at which the CPU executes the process of step 1620, the CPU makes an affirmative determination in step 1620, and executes the processes of step 1625 to step 1640 (described below). Due to this, the air/fuel ratio imbalance index value RIMBh is acquired.

Step 1625: The CPU acquires an element's temperature correction coefficient ktemp on the basis of the element's temperature correlation value AveTemp. The element's temperature correlation value AveTemp is a value that can be obtained by the routines shown in FIG. 17 and FIG. 18 (described below), and is an average value of the element's temperature Temp of the air/fuel ratio sensor 56 in the period in which the correction-purpose output value AveVaf is calculated. The element's temperature correction coefficient ktemp is determined so as to become greater the greater the element's temperature correlation value AveTemp. More concretely, the element's temperature correction coefficient ktemp is determined so as to gradually increase within a range above "1" as the element's temperature correlation value AveTemp becomes higher above a reference temperature (reference element's temperature) TO, and so as to gradually lessen within a range below "1" as the element's temperature correlation value AveTemp becomes lower below the reference temperature TO.

Step 1630: The CPU acquires a post-circuit-element-temperature-correction correction-purpose output value AveVafh (final correction-purpose output value AveVafh) by multiplying the correction-purpose output value AveVaf by an element's temperature correction coefficient ktemp. The correction-purpose output value AveVaf is a value obtained by the routines shown in FIG. 17 and FIG. 18 (described below), and is an average value of the output value Vabyfs during the fuel-cut period.

Step 1635: The CPU determines an index value correction coefficient kimb on the basis of the correction-purpose output value AveVafh so that the index value correction coefficient kimb lessens with increases in the correction-purpose output value AveVafh. More concretely, the index value correction coefficient kimb is determined so as to gradually lessen in a range above "1" as the correction-purpose output value AveVafh becomes greater above a "value Vcn that the correction-purpose output value AveVafh equals in the case where an air/fuel ratio sensor 56 whose responsiveness is a middle value of the tolerance is used", and so as to gradually increase in a range above "1" as the correction-purpose output value AveVafh becomes smaller below the value Vcn.

Step 1640: The CPU sets a value obtained by multiplying the pre-correction index quantity RIMB by the index value correction coefficient kimb (the multiplication product of the pre-correction index quantity RIMB and the index value correction coefficient kimb) as an air/fuel ratio fluctuation index quantity AFD (i.e., an air/fuel ratio imbalance index value RIMBh for use for the imbalance determination). As a result, the air/fuel ratio imbalance index value RIMBh equals the air/fuel ratio fluctuation index quantity acquired on the basis of the output value Vabyfs of the air/fuel ratio sensor 56 whose responsiveness is a predetermined value (a middle value of the tolerance) and whose element's temperature is the reference temperature TO. Therefore, the air/fuel ratio imbalance index value RIMBh accurately represents the degree of non-uniformity of the cylinder-by-cylinder air/fuel ratios.

Next, the CPU proceeds to step 1645, in which the CPU determines whether or not the air/fuel ratio imbalance index value RIMBh is greater than or equal to the imbalance determination threshold value Rth.

Then, if the air/fuel ratio imbalance index value RIMBh is greater than or equal to the imbalance determination threshold value Rth, the CPU makes an affirmative determination in step in step S1645, and proceeds to step S1650. In step 1650, the CPU sets the value of an imbalance occurrence flag XIMB to "1". That is, the CPU determines whether or not the inter-cylinder air/fuel ratio imbalance state is present. Furthermore, at this time, the CPU may turn on a warning lamp (not shown). Incidentally, the value of the imbalance occurrence flag XIMB is stored in the backup RAM. After that, the CPU proceeds to step 1660.

On the other hand, if the air/fuel ratio imbalance index value RIMBh is less than the imbalance determination threshold value Rth at the time point at which the CPU performs the process of step 1645, the CPU makes a negative determination in step 1645, and proceeds to step 1655. In step 1655, the CPU sets the value of the imbalance occurrence flag XIMB to "2". That is, the CPU stores the information that, as a result of the inter-cylinder air/fuel ratio imbalance determination, it has been determined that the inter-cylinder air/fuel ratio imbalance state is not present". After that, the CPU proceeds to step 1660. Incidentally, the process of step 1655 may be omitted.

In step 1660, the CPU sets the value of the imbalance determination completion flag XFIN to "1". Subsequently in step 1695, the CPU ends the present execution of this routine.

Due to the above-described construction, the pre-correction index quantity RIMB obtained on the basis of the rate of change ΔAF is corrected by the correction-purpose output value AveVafh. On the basis of the corrected value (air/fuel ratio imbalance index value RIMBh), the imbalance determination is executed.

Figure 17:
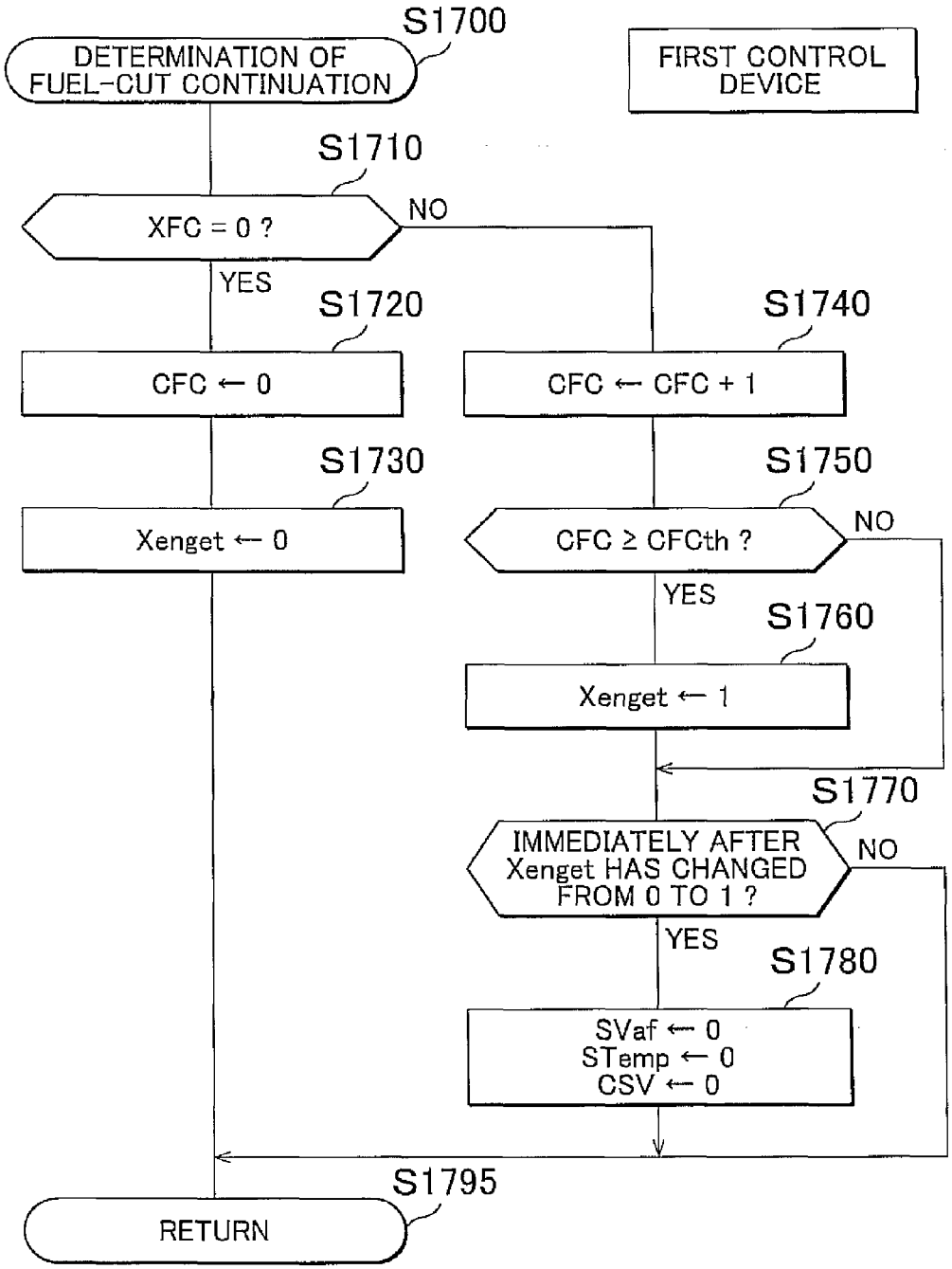
FIG. 17 is a flowchart showing a routine that is executed by the CPU of the first-embodiment determination apparatus.
Figure 18:
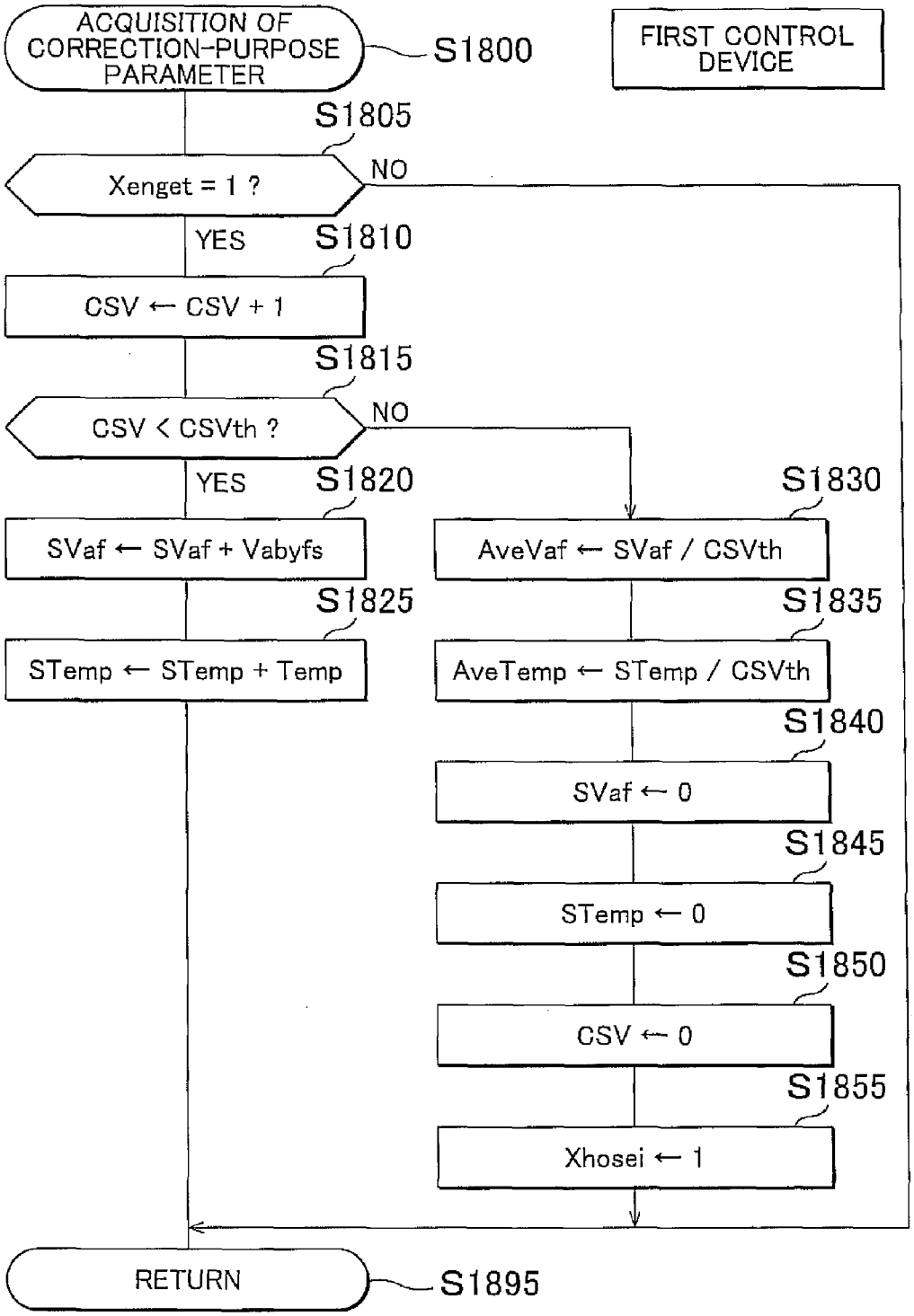
FIG. 18 is a flowchart showing a routine that is executed by the CPU of the first-embodiment determination apparatus.

Next, routines for acquiring the correction-purpose output value AveVaf and the element's temperature correlation value AveTemp (FIG. 17 and FIG. 18) will be described. The CPU executes each of the routines shown by flowcharts in FIG. 17 and FIG. 18 every time a predetermined time elapses. The routine shown in FIG. 17 is a routine for determining whether or not the fuel-cut state has continued for a predetermined time or longer, and for setting a flag for allowing the acquisition of the correction-purpose output value AveVaf (acquisition permission flag Xenget) to "1" in the case where the fuel-cut state has continued for the predetermined time or longer. The routine shown in FIG. 18 is a routine for acquiring the correction-purpose output value AveVaf and the like when the value of the acquisition permission flag Xenget is "1".

When a predetermined timing arrives, the CPU starts the routine process at step 1700 in FIG. 17, and proceeds to step 1710, in which the CPU determines whether or not the value of the fuel-cut flag XFC is "0". Let it assumed that the value of the fuel-cut flag XFC is "0" (i.e., that the fuel-cut is not being executed). In this case, the CPU makes an affirmative determination in step 1710, and then sequentially performs the processes of step 1720 and step 1730. After that, the CPU proceeds to step 1795, in which the CPU ends the present execution of this routine.

Step 1720: The CPU sets the value of a fuel-cut continuation counter CFC to "0". Incidentally, the value of the fuel-cut continuation counter CFC is set to "0" in the aforementioned initial routine.

Step 1730: The CPU sets the value of the acquisition permission flag Xenget to "0". Incidentally, the value of the acquisition permission flag Xenget is set to "0" in the aforementioned initial routine.

In the meantime, the CPU starts the process routine shown in FIG. 18 at step 1800, and proceeds to step 1805, in which the CPU determines whether or not the value of the acquisition permission flag Xenget is "1" At the present time point, the value of the acquisition permission flag Xenget is "0". Therefore, the CPU makes a negative determination in step 1805, and directly proceeds to step 1895, in which the CPU ends the present execution of this routine.

Now, let it assumed that the value of the fuel-cut flag XFC is set to "1" and therefore the fuel-cut begins to be executed. In this case, when the CPU proceeds to step 1710, the CPU makes a negative determination in step 1710 (XFC≠0), and proceeds to step 1740, in which the CPU increments the value of the fuel-cut continuation counter CFC by "1".

Next, the CPU proceeds to step 1750, in which the CPU determines whether or not the value of the fuel-cut continuation counter CFC is greater than or equal to a fuel-cut continuation threshold time CFCth. This determination is a step for ensuring that the exhaust gas produced by the fuel-cut operation (i.e., the atmospheric air) sufficiently exists around the air/fuel ratio sensor 56.

If the fuel-cut has not continued for a "time equivalent to the fuel-cut continuation threshold time CFCth", the CPU makes a negative determination in step 1750, and directly proceeds to step 1770. In step 1770, the CPU determines whether or not the value of the acquisition permission flag Xenget has just changed from "0" to "1". In this case, the value of the acquisition permission flag Xenget is kept at "0". Hence, the CPU makes a negative determination in step 1770, and directly proceeds to step 1795, in which the CPU ends the present execution of this routine.

On the other hand, if the fuel-cut continues and the value of the fuel-cut continuation counter CFC becomes greater than or equal to fuel-cut continuation threshold time CFCth, the CPU makes an affirmative determination in step 1750 (CFC≥CFCth), and proceeds to step 1760. In step 1760, the CPU sets the value of the acquisition permission flag Xenget to "1".

In this case, in step 1770, the CPU makes an affirmative determination (i.e., determines that the acquisition permission flag Xenget has just changed from "0" to "1"), and proceeds to step 1780. In step 1780, the CPU sets all of an accumulated output value SVaf, an accumulated element's temperature value STemp and a number-of-data-pieces counter CSV to "0". After that, the CPU proceeds to step 1795, in which the CPU ends the present execution of this routine.

If the CPU executes the process of step 1805 in FIG. 18 during the above-described state (i.e., the state in which the value of the acquisition permission flag Xenget has been set at "1"), the CPU makes an affirmative determination in step 1805 (Xenget=1), and proceeds to step 1810. In step 1810, the CPU increments the value of the number-of-data-pieces counter CSV by "1".

Next, the CPU proceeds to step 1815, in which the CPU determines whether or not the value of the number-of-data-pieces counter CSV is less than a number-of-data-pieces threshold value CSVth. Immediately after the value of the acquisition permission flag Xenget is changed from "0" to "1", the value of the number-of-data-pieces counter CSV is less than the number-of-data-pieces threshold value CSVth. Therefore, the CPU makes an affirmative determination in step 1815, and sequentially performs the processes of step 1820 and step 1825, and proceeds to step 1895, in which the CPU ends the present execution of this routine. [0216] Step 1820: The CPU updates the accumulated output value SVaf by adding the output value Vabyfs of the air/fuel ratio sensor 56 to the accumulated output value SVaf. That is, the accumulated output value SVaf is a value obtained by accumulating output values Vabyfs.

Step 1825: The CPU updates the accumulated element's temperature value STemp by adding the element's temperature Temp of the air/fuel ratio sensor 56 at that time point to the accumulated element's temperature value STemp. That is, the accumulated element's temperature value STemp is a value obtained by accumulating the element's temperature Temp.

Incidentally, the element's temperature Temp is a temperature of the solid electrolyte layer 561. The actual admittance (which is the reciprocal of the impedance and represents the ease of flow of electric current) becomes greater the higher the element's temperature Temp. The actual impedance of the solid electrolyte layer 561 becomes smaller the higher the element's temperature Temp. Therefore, the CPU estimates the element's temperature Temp (the temperature of the solid electrolyte layer 561) on the basis of the actual admittance Yact of the solid electrolyte layer 561. More concretely, the CPU periodically superposes a "detection voltage of a rectangular wave or a sine wave or the like" on an "applied voltage from the electric power supply 569" and then, on the basis of the current that flows in the solid electrolyte layer 561 and the output value Vabyfs, acquires the actual admittance Yact of the air/fuel ratio sensor 56. Incidentally, the method of acquiring the admittance (or the impedance as a reciprocal of the admittance) is well known, and is described in, for example, Japanese Patent Application Publication No. 2001-74693 (JP-A-2001-74693), Japanese Patent Application Publication No. 2002-48761 (JP-A-2002-48761), Japanese Patent Application Publication No. 2007-17191 (JP-A-2007-17191), etc.

If fuel-cut continues, the process of step 1730 in FIG. 17 is not executed. Therefore, the value of the acquisition permission flag Xenget is kept at "1". As a result, the value of the fuel-cut continuation counter DVD is gradually incremented by the process of step 1810 in FIG. 18 to become greater than or equal to the number-of-data pieces threshold value SCVth. At this time, when the CPU proceeds to step 1815 in FIG. 18, the CPU makes a negative determination in step 1815 (CSC≥CSVth), and sequentially performs the processes of steps 1830 to 1855 described below, and then proceeds to step 1895, in which the CPU ends the present execution of this routine.

Step 1830: The CPU obtains the correction-purpose output value AveVaf that precedes the correction by the element's temperature. That is, the correction-purpose output value AveVaf preceding the element's temperature correction is an average value of the number-of-data-pieces threshold value CSVth of the output value Vabyfs during the fuel-cut operation after the fuel-cut continuation threshold time CFCth elapses following the start of the fuel-cut.

Step 1835: The CPU obtains the element's temperature correction value AveTemp by dividing the value of the element's temperature accumulated value STemp by the number-of-data-pieces threshold value CSVth. That is, the element's temperature correlation value AveTemp is an average value of the number-of-data-pieces threshold value CSVth of the element's temperature Temp during the fuel-cut operation after the fuel-cut continuation threshold time CFCth elapses following the start of the fuel-cut.

Step 1840: The CPU sets the accumulated output value SVaf to "0". Step 1845: The CPU sets the accumulated element's temperature value STemp to "0". Step 1850: The CPU sets the value of the number-of-data-pieces counter CSV to "0". Step 1855: The CPU sets the value of the correction feasibility flag Xhosei to "1".

As a result, at the time point of executing the process of step 1620 in FIG. 16, the CPU makes an affirmative determination in step 1620, and executes the processes of step 1625 and later steps. Therefore, the imbalance determination is executed.

Incidentally, if the fuel-cut continues after that, the number-of-data-pieces counter CSV is gradually incremented from "0" (see step 1850 and step 1810). When the value of the number-of-data-pieces counter CSV becomes equal to the number-of-data pieces threshold value CSVth, "the correction-purpose output value AveVaf preceding the element's temperature correction and the element's temperature correlation value AveTemp" are updated by the processes of steps 1830 and 1835. Furthermore, during the fuel-cut operation, the imbalance determination is not executed (see the negative determination in step 1605 in FIG. 16), the imbalance determination and the correction of the pre-correction index quantity RIMB are executed on the basis of "the correction-purpose output value AveVaf preceding the element's temperature correction and the element's temperature correlation value AveTemp" that are the latest.

Furthermore, if the fuel-cut ends (the value of the fuel-cut flag XFC is set to "0") before the value of the number-of-data-pieces counter CSV reaches the number-of-data-pieces threshold value CSVth, the CPU sets the value of the acquisition permission flag Xenget to "0" in step 1730 in FIG. 17. As a result, the CPU makes a negative determination in step 1805 in FIG. 18, and directly proceeds to step 1895. Therefore, in this case, "the accumulated output value SVaf and the accumulated element's temperature value STemp" that have been updated are discarded (see step 1780 in FIG. 17).

As described above, the first-embodiment determination apparatus includes: an injection command signal send-out device that sends out an injection command signal to a plurality of fuel injection valves 33 so that each of the fuel injection valves 33 injects an amount of fuel commensurate with a predetermined commanded fuel injection amount Fi (see FIG. 12); a fuel-cut device that executes the fuel-cut operation by stopping the fuel injection from the fuel injection valves 33 when a predetermined fuel-cut condition is satisfied (see the negative determination in step 1210 in FIG. 12); an air/fuel ratio imbalance index value acquisition device that acquires the air/fuel ratio imbalance index value RIMBh that is greater the greater the degree of non-uniformity between a plurality of cylinders in terms of the air/fuel ratio of the mixture supplied into the combustion chambers of the cylinders (the cylinder-by-cylinder air-fuel ratios) (see FIG. 15, and steps 1605 to 1640 in FIG. 16); and an imbalance determination device that determines whether or not the inter-cylinder air/fuel ratio imbalance state has occurred, on the basis of a result of comparison between the acquired air/fuel ratio imbalance index value RIMBh and a predetermined imbalance determination threshold value Rth (see steps 1645 to 1655 in FIG. 16).

Furthermore, the air/fuel ratio imbalance index value acquisition device of the first-embodiment determination apparatus acquires a correction-purpose output value AveVaf that is greater the greater the output value Vabyfs of the air/fuel ratio sensor 56 during execution of the fuel-cut operation (see FIG. 17 and FIG. 18), and acquires as the air/fuel ratio imbalance index value RIMBh an air/fuel ratio fluctuation index quantity that is greater the greater the fluctuation of the output value of the air/fuel ratio sensor and that is smaller the greater the correction-purpose output value AveVaf, on the basis of the output value Vabyfs of the air/fuel ratio sensor 56 and the correction-purpose output value AveVaf (see FIG. 15, and steps 1625 to 1640 in FIG. 16).

According to this construction, the correction-purpose output value AveVaf is acquired as a value that is greater the higher the responsiveness of the air/fuel ratio sensor 56, so that the air/fuel ratio fluctuation index quantity (air/fuel ratio imbalance index value RIMBh) is acquired provided that the responsiveness of the air/fuel ratio sensor 56 is a "specific value (e.g., a middle value of the tolerance)". Therefore, the air/fuel ratio fluctuation index quantity (i.e., the air/fuel ratio imbalance index value) accurately represents the degree of non-uniformity of the cylinder-by-cylinder air/fuel ratios, and therefore allows the imbalance determination to be accurately performed.

Furthermore, the air/fuel ratio imbalance index value acquisition device of the first-embodiment determination apparatus acquires a "pre-correction index quantity RIMB that serves as a basis for the air/fuel ratio fluctuation index quantity on the basis of the output value Vabyfs of the air/fuel ratio sensor 56 (see steps 1510 to 1535 in FIG. 15), and acquires the air/fuel ratio fluctuation index quantity RIMBh by correcting the pre-correction index quantity RIMB on the basis of the correction-purpose output value AveVaf so that the pre-correction index quantity RIMB is smaller the greater the correction-purpose output value AveVaf (see steps 1625 to 1640 in FIG. 16).

As a result, the air/fuel ratio imbalance index value RIMBh accurately represents the degree of non-uniformity of the cylinder-by-cylinder air/fuel ratios independently of the air/fuel ratio sensor 56, so that the imbalance determination can be accurately carried out.

Furthermore, the air/fuel ratio imbalance index value acquisition device of the first-embodiment determination apparatus acquires an element's temperature correlation value AveTemp that is greater the higher the element's temperature of the air/fuel ratio sensor occurring when the correction-purpose output value AveVaf is being acquired (see steps 1825 and 1835 in FIG. 18, and the like), and corrects the correction-purpose output value AveVaf on the basis of the element's temperature correlation value AveTemp so that the correction-purpose output value AveVaf is greater the greater the element's temperature correlation value AveTemp, and corrects the pre-correction index quantity RIMB on the basis of the corrected correction-purpose output value AveVafh (see steps 1625 to 1640 in FIG. 16).

According to this construction, the correction-purpose output value AveVafh that is corrected by the element's temperature correlation value AveTemp shows the responsiveness of the air/fuel ratio sensor, regardless of the element's temperature of the air/fuel ratio sensor occurring when the correction-purpose output value AveVaf is being acquired. Therefore, the air/fuel ratio imbalance index value RIMBh even more accurately represents the degree of non-uniformity of the cylinder-by-cylinder air/fuel ratios, so that the imbalance determination can be accurately carried out.

Next, a first modification of the first embodiment will be described. This modification acquires the air/fuel ratio fluctuation index quantity (air/fuel ratio imbalance index value) RIMBh by directly correcting the pre-correction index quantity RIMB on the basis of the element's temperature correlation value AveTemp so that the pre-correction index quantity RIMB is greater the greater the element's temperature correlation value AveTemp.

With this construction, too, the air/fuel ratio imbalance index value RIMBh becomes a value that even more accurately represents the degree of non-uniformity of the cylinder-by-cylinder air/fuel ratios, regardless of the element's temperature correlation value AveTemp, so that the imbalance determination can be accurately carried out.

Next, a second modification of the first embodiment will be described. The second modification is constructed so as to acquire a post-responsiveness-correction sensor output value Vh by correcting the output value Vabyfs of the air/fuel ratio sensor 56 on the basis of the correction-purpose output value AveVaf so that the output value Vabyfs of the air/fuel ratio sensor 56 is smaller the greater the correction-purpose output value AveVaf (or the correction-purpose output value AveVafh), and so as to acquire an air/fuel ratio fluctuation index quantity RIMBh on the basis of the post-responsiveness-correction sensor output value Vh. That is, the second modification directly acquires the air/fuel ratio imbalance index value RIMBh in step 1535 in FIG. 15 by replacing the post-responsiveness-correction sensor output value Vh with the "output value Vabyfs acquired in step 1510 in FIG. 15". Furthermore, the processes of steps 1625 to 1640 in FIG. 16 are omitted.

According to this construction, the output value Vabyfs of the air/fuel ratio sensor 56 is corrected to a value Vh that is smaller the greater the "correction-purpose output value AveVaf that is greater the higher the responsiveness". Therefore, the air/fuel ratio fluctuation index quantity acquired on the basis of the corrected output value Vh of the air/fuel ratio sensor is a value that accurately shows the degree of non-uniformity of the cylinder-by-cylinder air/fuel ratios regardless of the responsiveness of the air/fuel ratio sensor 56. As a result, the imbalance determination can be accurately carried out.

Next, a third modification of the first embodiment will be described. In the first-embodiment determination apparatus and its modifications, the corrections based on the element's temperature correlation value AveTemp may be omitted. In this case, for example, step 1625 in FIG. 16 is omitted, and "1" is substituted for the element's temperature correction coefficient ktemp in step 1630. Furthermore, step 1825, step 1835 and step 1845 in FIG. 18 are omitted.

Next, a fourth modification of the first embodiment will be described. The fourth modification is constructed to execute the processes of steps 1625 to 1635 in FIG. 16 between step 1835 and step 1840 shown in FIG. 18. According to this modification, the index value correction coefficient kimb is calculated every time the correction-purpose output value AveVaf and the element's temperature correlation value AveTemp are acquired.

Next, a fifth modification of the first embodiment will be described. The fifth modification is constructed so as to execute the processes of steps 1625 to 1640 in FIG. 16 between step 1535 and step 1540 shown in FIG. 15. According to this modification, the pre-correction index quantity RIMB is corrected on the basis of the correction-purpose output value AveVafh (the correction-purpose output value AveVaf and the element's temperature correlation value AveTemp) every time the pre-correction index quantity RIMB is acquired.

Next, an inter-cylinder air/fuel ratio imbalance determination apparatus in accordance with a second embodiment of the invention (hereinafter, referred to simply as "second-embodiment determination apparatus") will be described. The second-embodiment determination apparatus is different from the first-embodiment determination apparatus in that the second-embodiment determination apparatus is constructed so as to avoid execution of the calculation of the air/fuel ratio imbalance index value RIMBh and avoid execution of the imbalance determination if the travel distance accumulated from the time point of acquisition of the correction-purpose output value AveVaf is greater than or equal to a threshold travel distance. Hereinafter, the differences will be described.

As mentioned above, the value ($P_{O2}/P$) of the right side of the equation (1) is constant despite changes in the atmospheric pressure. Therefore, it can be understood from the expression (1) that the limiting current value IL is proportional to the total pressure P of exhaust gas. Therefore, the limiting current value IL (output value Vabyfs) greatly differs between when the vehicle equipped with the engine 10 is driven on a low land with a relatively great atmospheric pressure and when the vehicle is driven on a high land with a relatively small atmospheric pressure. That is, the output value Vabyfs changes depending on altitude.

On the other hand, an amount of time is required before the pre-correction index quantity RIMB is acquired, in the case where the parameter acquisition condition is not continuously satisfied (the case where the value of the parameter acquisition permission flag Xkyoka is "0"). Therefore, in some cases, the vehicle's altitude at the time of acquisition of the correction-purpose output value AveVaf and the vehicle's altitude at the time point of acquisition of the pre-correction index quantity RIMB are greatly different from each other. In such a case, the correction-purpose output value AveVaf does not accurately represent the responsiveness of the air/fuel ratio sensor 56 at the time point of acquisition of the pre-correction index quantity RIMB, and is therefore not appropriate as a value for correcting the pre-correction index quantity RIMB.

On the other hand, the longer the travel distance of the vehicle, the higher the possibility of a change in the altitude of the vehicle. Therefore, the second-embodiment determination apparatus does not execute the calculation of the air/fuel ratio imbalance index value RIMBh by using the correction-purpose output value AveVafh and does not execute the imbalance determination, if the travel distance of the vehicle accumulated from the time point of acquisition of the correction-purpose output value AveVaf is greater than or equal to a threshold travel distance.

A CPU of the second-embodiment determination apparatus executes the same routines as the CPU of the first-embodiment determination apparatus. Furthermore, the CPU of the second-embodiment determination apparatus executes a routine shown in FIG. 19 every time a predetermined time elapses.

Hence, when a predetermined timing arrives, the CPU starts the routine process at step 1900, and proceeds to step 1910, in which the CPU determines whether or not the present time point is a "time point that immediately follows the update of the correction-purpose output value AveVaf in step 1830 in FIG. 18".

If the present time point is the "time point that immediately follows the update of the correction-purpose output value AveVaf in step 1830 in FIG. 18", the CPU makes an affirmative determination in step 1910, and proceeds to step 1920, in which the CPU sets a travel distance Dis to "0". Next, the CPU proceeds to step 1940.

On other hand, if the time point at which the CPU executes the process of step 1910 is not a time point that immediately follows the update of the correction-purpose output value AveVaf, the CPU makes a negative determination in step 1910, and proceeds to step 1930, in which the CPU adds a vehicle speed spd to the travel distance Dis. That is, the CPU updates the travel distance Dis by integrating (accumulating) the vehicle speed spd. Next, the CPU proceeds to step 1940.

As a result, the travel distance Dis is a value that shows the travel distance (moving distance) of the vehicle from the time point at which the correction-purpose output value AveVaf is updated.

In step 1940, the CPU determines whether or not the travel distance Dis is greater than or equal to a threshold travel distance Disth. The threshold travel distance Disth is set at a value of distance the vehicle's travel of or beyond which will likely involve such a change in the vehicle's altitude that the present value of the correction-purpose output value AveVaf may possibly be no longer appropriate to use for the correction of the pre-correction index quantity RIMB.

If the travel distance Dis is less than the threshold travel distance Disth, the CPU makes a negative determination in step 1940, and directly proceeds to step 1995, in which the CPU ends the present execution of this routine.

On the other hand, if the threshold travel distance Disth is greater than or equal to the travel distance Dis, the CPU makes an affirmative determination in step 1940, and sequentially performs the processes of step 1950 and step 1960, and then proceeds to step 1995, in which the CPU ends the present execution of this routine.

Step 1950: The CPU sets the value of the correction feasibility flag Xhosei to "0". Due to this, when the CPU proceeds to step 1620 in FIG. 16, the CPU makes a negative determination in step 1620 (Xhosei≠1). As a result, the processes of step 1625 and later steps in FIG. 16 are not executed, so that the correction of the pre-correction index quantity RIMB (the calculation of the air/fuel ratio imbalance index value RIMBh) and the imbalance determination are not executed.

Step 1960: The CPU sets the value of the imbalance determination feasibility flag Xhantei to "0". Due to this, when the CPU proceeds to step 1615 in FIG. 16, the CPU makes a negative determination in step 1615 (Xhantei≠1). As a result, the processes in step 1625 and later steps in FIG. 16 are not executed, so that the correction of the pre-correction index quantity RIMB (the calculation of the air/fuel ratio imbalance index value RIMBh) and the imbalance determination are not executed.

Figure 19:
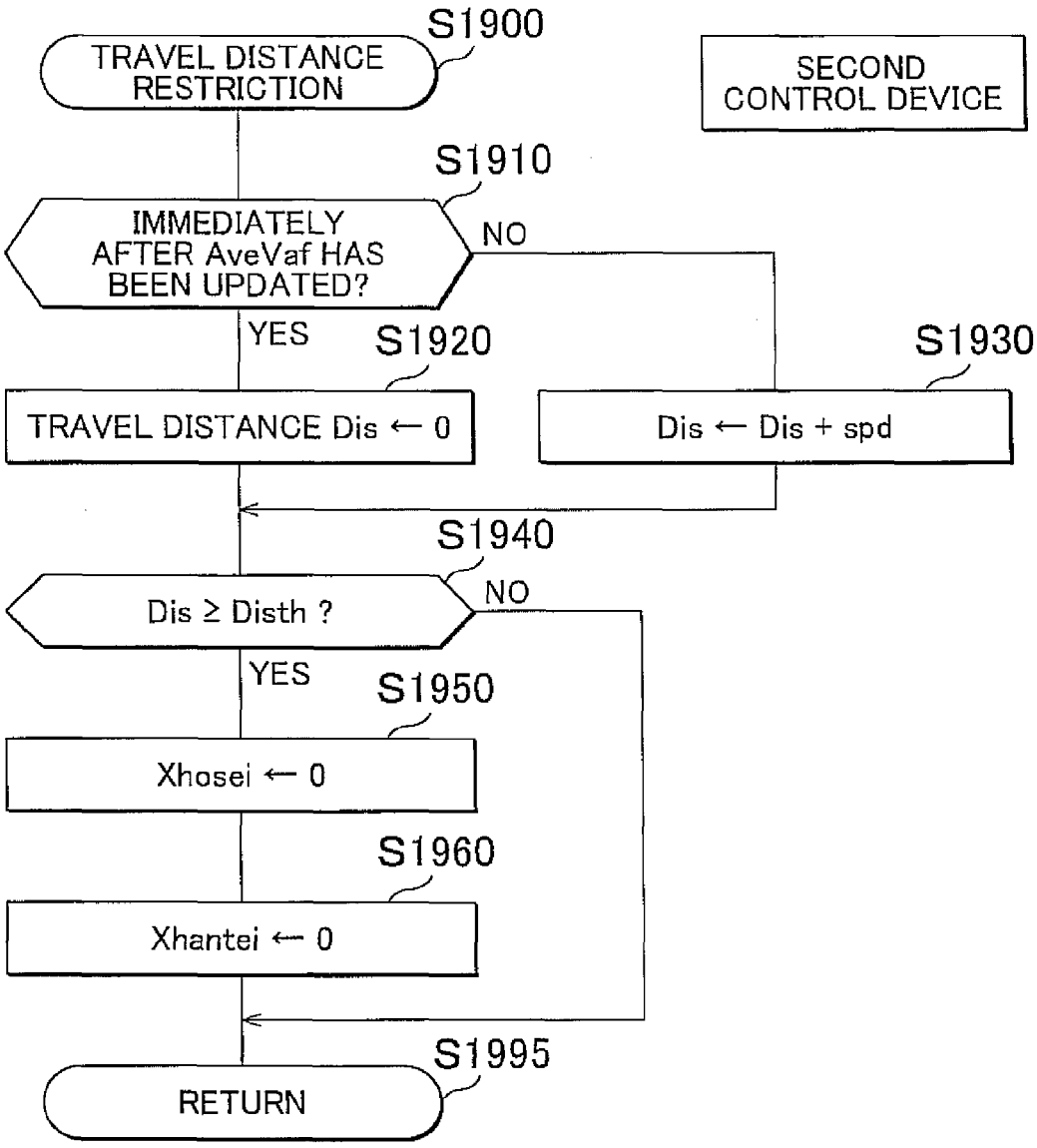
FIG. 19 is a flowchart showing a routine that is executed by a CPU of an inter-cylinder air/fuel ratio imbalance determination apparatus (second-embodiment determination apparatus) in accordance with a second embodiment of the invention.

Incidentally, either one of step 1950 and step 1960 in FIG. 19 may be omitted.

According to the second-embodiment determination apparatus, there does not occur the "implementation of the imbalance determination based on the air/fuel ratio imbalance index value that is acquired or corrected on the basis of an inappropriate correction-purpose output value AveVaf", so that occurrence of a false determination can be avoided.

Thus, since the inter-cylinder air/fuel ratio imbalance determination apparatus in accordance with each of the foregoing embodiments of the invention is able to acquire the air/fuel ratio imbalance index value that accurately represents the degree of non-uniformity of the cylinder-by-cylinder air/fuel ratios regardless of the responsiveness of the air/fuel ratio sensor 56, the apparatus is able to accurately execute the imbalance determination.

The invention is not limited to the foregoing embodiments, but may adopt various modifications within the scope of the invention. For example, the pre-correction index quantity RIMB may be acquired by the method as described below. Incidentally, the output value Vabyfs of the air/fuel ratio sensor 56 described below means a value that correlates with the output value Vabyfs of the air/fuel ratio sensor 56. That is, the output value Vabyfs of the air/fuel ratio sensor 56 described below may be the output value Vabyfs of the air/fuel ratio sensor 56, or may also be a value obtained by performing a high-pass filtering process on the output value Vabyfs of the air/fuel ratio sensor 56 (i.e., a post-high-pass-filtering output value VHPF) so that fluctuating components of the average of the air/fuel ratio of the engine 10 (a center air/fuel ratio, a base air/fuel ratio) are removed from the output value Vabyfs of the air/fuel ratio sensor 56.

(A-1) The determination device can be constructed so as to acquire a differential value d(Vabyfs)/dt(rate of change ΔAF) of the output value Vabyfs of the air/fuel ratio sensor 56 with respect to time, and so as to acquire a value that correlates with the acquired differential value d(Vabyfs)/dt as a pre-correction index quantity RIMB.

An example of the acquired value that correlates with the differential value d(Vabyfs)/dt is an average value of the absolute values of a plurality of differential values d(Vabyfs)/dt acquired during the unit combustion cycle or a period that is a natural number times the unit combustion cycle, as mentioned above. Another example of the acquired value that correlates with the differential value d(Vabyfs)/dt is a value obtained by averaging values acquired with respect to a plurality of unit combustion cycles each of which is the maximum value of the absolute values of a plurality of differential values d(Vabyfs)/dt acquired in a corresponding one of the unit combustion cycles.

A still another example of the acquired value that correlates with the differential value d(Vabyfs)/dt may be acquired as follows.

During a unit combustion cycle period, the absolute value of a positive differential value d(Vabyfs)/dt is acquired every time a predetermined sampling time elapses, and an average value ΔAFPL of the acquired absolute values is obtained.

During a unit combustion cycle period, the absolute value of a negative differential value d(Vabyfs)/dt is acquired every time the predetermined sampling time elapses, and an average value ΔAFMN of the acquired absolute values is obtained.

During a unit combustion cycle period, the larger one of the average value ΔAFPL and the average value ΔAFMN is adopted as a rate of change ΔAF during the unit combustion cycle period.

An average value of the rates of change ΔAF acquired as described above during each of a plurality of unit combustion cycle periods is adopted as the pre-correction index quantity RIMB.

(A-2) The determination device can be constructed so as to acquire a time differential value d(abyfs)/dt of the detected air/fuel ratio abyfs that is expressed by the output value Vabyfs of the air/fuel ratio sensor 56 and so as to acquire a value that correlates with the acquired differential value d(abyfs)/dt as a pre-correction index quantity RIMB.

An example of the value that correlates with the acquired differential value d(abyfs)/dt is an average value of the absolute values of a plurality of differential values d(abyfs)/dt acquired during the period of a unit combustion cycle or of a natural number times the unit combustion cycle. Another example of the value that correlates with the acquired differential value d(abyfs)/dt is a value obtained by averaging values acquired with respect to a plurality of unit combustion cycles each of which is the maximum value of the absolute values of a plurality of differential values d(abyfs)/dt acquired during a corresponding one of the plurality of unit combustion cycles.

Figure 8D:
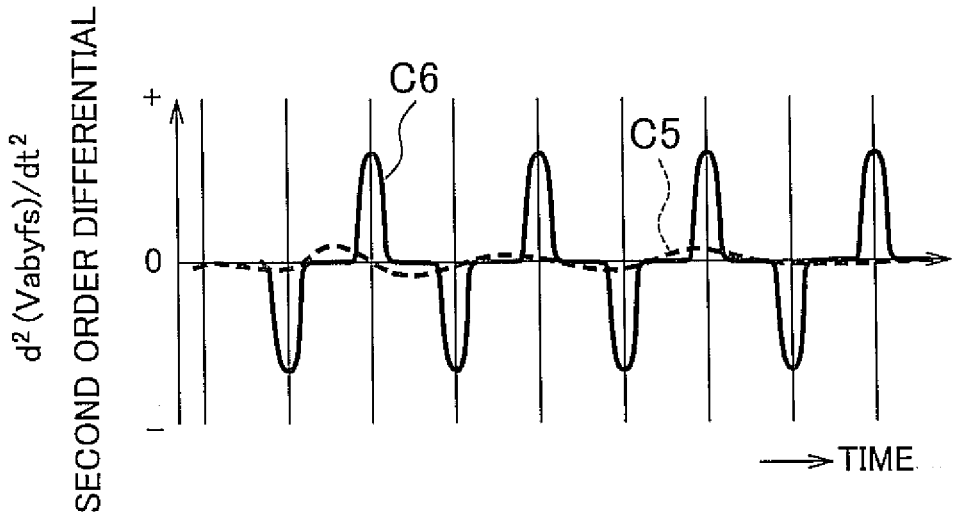

(A-3) The determination device can be constructed so as to acquire a time second order differential value $d^2$(Vabyfs)/$dt^2$ of the output value Vabyfs of the air/fuel ratio sensor 56 and so as to acquire a value that correlates with the acquired second order differential value $d^2$(Vabyfs)/$dt^2$ as a pre-correction index quantity RIMB. The second order differential value $d^2$(Vabyfs)/$dt^2$ becomes a relatively small value when the cylinder-by-cylinder air/fuel ratio difference is small, as shown by an interrupted line C5 in FIG. 8D. When the cylinder-by-cylinder air/fuel ratio difference is large, the second order differential value $d^2$(Vabyfs)/$dt^2$ becomes a relatively large value as shown by a solid line C6 in FIG. 8D.

Incidentally, the second order differential value $d^2$(Vabyfs)/$dt^2$ can be obtained by obtaining a differential value d(Vabyfs)/dt for every constant sampling time through subtraction of an output value Vabyfs occurring at the constant sampling time prior to the present time point from the output value Vabyfs occurring at the present time point, and by subtracting from the newly obtained differential value d(Vabyfs)/dt a differential value d(Vabyfs)/dt occurring at the constant sampling time prior to the time point of the newly obtained differential value d(Vabyfs)/dt.

An example of the value that correlates with the acquired second order differential value $d^2$(Vabyfs)/$dt^2$ is an average value of the absolute values of a plurality of second order differential values $d^2$(Vabyfs)/$dt^2$ acquired during the period of a unit combustion cycle or of a natural number times the unit combustion cycle. Another example of the value that correlates with the second order differential value $d^2$(Vabyfs)/$dt^2$ is a value obtained by averaging values acquired with respect to a plurality of unit combustion cycles each of which is the maximum value of the absolute values of a plurality of second order differential values $d^2$(Vabyfs)/$dt^2$ acquired in a corresponding one of the plurality of unit combustion cycles.

(A-4) The determination device can be constructed so as to acquire a time second order differential value $d^2$(abyfs)/$dt^2$ of the detected air/fuel ratio abyfs that is expressed by the output value Vabyfs of the air/fuel ratio sensor 56 and so as to acquire a value that correlates with the acquired second order differential value $d^2$(abyfs)/$dt^2$ as a pre-correction index quantity RIMB. Since the output value Vabyfs and the detected air/fuel ratio abyfs are substantially in a proportional relation (see FIG. 6), the second order differential value $d^2$(abyfs)/$dt^2$ exhibits substantially the same tendency as the second order differential value $d^2$(abyfs)/$dt^2$ of the output value Vabyfs.

An example of the value that correlates with the acquired second order differential value $d^2$(abyfs)/$dt^2$ is an average value of the absolute values of a plurality of second order differential value $d^2$(abyfs)/$dt^2$ acquired during the period of a unit combustion cycle or of a natural number times the unit combustion cycle. Another example of the value that correlates with the acquired second order differential value $d^2$(abyfs)/$dt^2$ is a value obtained by averaging values which are acquired with respect to a plurality of unit combustion cycles and each of which is the maximum value of the absolute values of a plurality of second order differential values $d^2$(abyfs)/$dt^2$ acquired in a corresponding one of the plurality of unit combustion cycles.

(A-5) The determination device can be constructed so as to acquire as a pre-correction index quantity RIMB a value that correlates with a difference ΔX between the maximum value and the minimum value of the output value Vabyfs during a predetermined period (e.g., the period of a natural number times the unit combustion cycle), or a value that correlates with a difference ΔY between the maximum value and the minimum value of the detected air/fuel ratio abyfs that is expressed by the output value Vabyfs of the air/fuel ratio sensor 56 during a predetermined period. As is apparent from a solid line C2 and an interrupted line C1 shown in FIG. 8B, the difference ΔX (the absolute value of ΔX) and the difference ΔY (the absolute value of ΔY) are greater the greater the cylinder-by-cylinder air/fuel ratio difference. Therefore, the difference ΔX (the absolute value ΔX) is greater the greater the cylinder-by-cylinder air/fuel ratio difference. An example of the value that correlates with the difference ΔX (or the difference ΔY) is an average value of the absolute values of a plurality of differences ΔX (or differences ΔY) acquired during the period of a unit combustion cycle or of a natural number times the unit combustion cycle.

(A-6) The determination device can be constructed so as to acquire as the pre-correction index quantity RIMB a value that correlates with the locus length of the output value Vabyfs of the air/fuel ratio sensor 56 for a predetermined period or a value that correlates with the locus length of the detected air/fuel ratio abyfs expressed by the output value Vabyfs of the air/fuel ratio sensor 56 for the predetermined period. These locus lengths are greater the greater the cylinder-by-cylinder air/fuel ratio difference, as is apparent from FIG. 8B. A value that correlates with either one of the locus lengths is, for example, an average value of the absolute values of a plurality of locus lengths acquired in the period of a unit combustion cycle or of a natural number times the unit combustion cycle.

Incidentally, for example, the locus length of the detected air/fuel ratio abyfs can be obtained by acquiring the output value Vabyfs every time a constant sampling time ts elapses, and converting the output value Vabyfs into a detected air/fuel ratio abyfs, and accumulating the absolute values of differences between the detected air/fuel ratio abyfs and the detected air/fuel ratio abyfs that is acquired the constant sampling time ts before.

In addition, the foregoing determination devices can also be applied to a V-type engine. In a V-type engine provided in such a case, a right-side bank upstream-side catalyst is provided downstream of an exhaust confluence portion of two or more cylinders formed in the right-side bank. Furthermore, in the V-type engine, a left-side bank upstream-side catalyst is provided downstream of an exhaust confluence portion of two or more cylinders formed in the left-side bank.

In addition, in the V-type engine, an upstream-side air/fuel ratio sensor and a downstream-side oxygen concentration sensor for the right-side bank are provided upstream and downstream, respectively, of the right-side bank upstream-side catalyst, and an upstream-side air/fuel ratio sensor and a downstream-side oxygen concentration sensor for the left-side bank are provided upstream and downstream, respectively, of the left-side bank upstream-side catalyst. Each of the upstream-side air/fuel ratio sensors is disposed between the exhaust confluence portion of the corresponding bank and the upstream-side catalyst of the corresponding bank, as is the case with the air/fuel ratio sensor 56. In this construction, the execution of the main and subsidiary feedback controls for the right-side bank and the execution of the main and subsidiary feedback controls for the left-side bank are carried out independently of each other.

Furthermore, in this case, the determination device may obtain an "air/fuel ratio imbalance index value RIMBh for the right-side bank" on the basis of the output value of the upstream-side air/fuel ratio sensor for the right-side bank, and may execute the imbalance determination regarding the cylinders formed in the right-side bank by using the obtained air/fuel ratio imbalance index value RIMBh. Likewise, the determination device may obtain an "air/fuel ratio imbalance index value RIMBh for the left-side bank" on the basis of the output value of the upstream-side air/fuel ratio sensor for the left-side bank, and may execute the imbalance determination regarding the cylinders formed in the left-side bank by using the obtained air/fuel ratio imbalance index value RIMBh.

Furthermore, in the first-embodiment determination apparatus and the second-embodiment determination apparatus, the subsidiary feedback amount KSFB is a value for directly corrects the target air/fuel ratio abyfr. However, instead of this, a "subsidiary feedback amount Vafsfb calculated in substantially the same manner as the subsidiary feedback amount KSFB" may be added to the output value Vabyfs of the air/fuel ratio sensor 56 as in the following expression (18) so as to acquire an output value Vabyfc for the feedback control.

$$Vabyfc = Vabyfs + Vafsfb \quad (18)$$

Then, as shown in the following expression (19), the feedback control-purpose output value Vabyfc may be applied to the table Mapabyfs shown in FIG. 6 so as to acquire a feedback control-purpose air/fuel ratio abyfsc. Then, a main feedback amount DFi may be obtained such that the feedback control-purpose air/fuel ratio abyfsc equals a target air/fuel ratio abyfr(=stoich)". That is, in this construction, the target air/fuel ratio abyfr is not directly corrected by the subsidiary feedback amount, but is substantially corrected by correcting the output value Vabyfs of the air/fuel ratio sensor 56 by the subsidiary feedback amount.

$$abyfsc=Mapabyfs(Vabyfc) \quad (19)$$

While the invention has been described with reference to example embodiments thereof, it is to be understood that the invention is not limited to the example described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. An inter-cylinder air/fuel ratio imbalance determination apparatus, comprising:

an air/fuel ratio sensor that is a limiting current type sensor that is disposed in an exhaust confluence portion of an exhaust passageway of a multi-cylinder internal combustion engine in which flows of exhaust gas discharged from a plurality of cylinders of the engine meet, or is disposed downstream of the exhaust confluence portion;

a plurality of fuel injection valves that inject a fuel that is contained in a mixture that is supplied into a combustion chamber of each of the cylinders;

an injection command signal send-out device that is configured to send out an injection command signal to the fuel injection valves so that each of the fuel injection valves injects an amount of the fuel that is commensurate with a predetermined commanded fuel injection amount;

a fuel-cut device that is configured to execute a fuel-cut operation by stopping fuel injection performed by the fuel injection valves when a predetermined fuel-cut condition is satisfied;

an air/fuel ratio imbalance index value acquisition device that is configured to acquire an air/fuel ratio imbalance index value that increases with increase in degree of non-uniformity between the cylinders in a cylinder-by-cylinder air/fuel ratio that is an air/fuel ratio of the mixture supplied into the combustion chamber of each of the cylinders;

an imbalance determination device that is configured to determine whether or not an inter-cylinder air/fuel ratio imbalance state has occurred, based on a result of comparison between the air/fuel ratio imbalance index value acquired and a predetermined imbalance determination threshold value, wherein the air/fuel ratio imbalance index value acquisition device is configured to acquire a correction-purpose output value that increases with increase in output value of the air/fuel ratio sensor during a period of execution of the fuel-cut operation, and to acquire as the air/fuel ratio imbalance index value an air/fuel ratio fluctuation index quantity that increases with increase in fluctuation of the output value of the air/fuel ratio sensor and that decreases with increase in the correction-purpose output value, based on the output value of the air/fuel ratio sensor and the correction-purpose output value.

2. The inter-cylinder air/fuel ratio imbalance determination apparatus according to claim 1, wherein the air/fuel ratio imbalance index value acquisition device acquires a pre-correction index quantity that serves as a basis for the air/fuel ratio fluctuation index quantity, based on the output value of the air/fuel ratio sensor, and acquires the air/fuel ratio fluctuation index quantity by correcting the pre-correction index quantity based on the correction-purpose output value so that the pre-correction index quantity decreases with increase in the correction-purpose output value.

3. The inter-cylinder air/fuel ratio imbalance determination apparatus according to claim 2, wherein the air/fuel ratio imbalance index value acquisition device acquires an element's temperature correlation value that increases with increase in element's temperature of the air/fuel ratio sensor occurring when the correction-purpose output value is acquired, and corrects the correction-purpose output value based on the element's temperature correlation value so that the correction-purpose output value increases with increase in the element's temperature correlation value, and corrects the pre-correction index quantity based on the correction-purpose output value corrected.

4. The inter-cylinder air/fuel ratio imbalance determination apparatus according to claim 2, wherein the air/fuel ratio imbalance index value acquisition device acquires an element's temperature correlation value that increases with increase in element's temperature of the air/fuel ratio sensor occurring when the correction-purpose output value is acquired, and acquires the air/fuel ratio fluctuation index quantity by correcting the pre-correction index quantity based on the element's temperature correlation value so that the pre-correction index quantity increases with increase in the element's temperature correlation value.

5. The inter-cylinder air/fuel ratio imbalance determination apparatus according to claim 2, wherein the engine is an engine mounted in a vehicle, and the imbalance determination device does not execute determination as to whether or not the inter-cylinder air/fuel ratio imbalance state has occurred, if travel distance of the vehicle from a time point of acquisition of the correction-purpose output value is greater than or equal to a threshold travel distance.

6. The inter-cylinder air/fuel ratio imbalance determination apparatus according to claim 2, wherein the engine is an engine mounted in a vehicle, and the imbalance determination device does not execute calculation of the air/fuel ratio imbalance index value, if travel distance of the vehicle from a time point of acquisition of the correction-purpose output value is greater than or equal to a threshold travel distance.

7. The inter-cylinder air/fuel ratio imbalance determination apparatus according to claim 1, wherein the air/fuel ratio imbalance index value acquisition device acquires a post-responsiveness-correction sensor output value by correcting the output value of the air/fuel ratio sensor based on the correction-purpose output value so that the output value of the air/fuel ratio sensor decreases with increase in the correction-purpose output value, and acquires the air/fuel ratio fluctuation index quantity based on the post-responsiveness-correction sensor output value.

8. The inter-cylinder air/fuel ratio imbalance determination apparatus according to claim 7, wherein the engine is an engine mounted in a vehicle, and the imbalance determination device avoids executing determination as to whether or not the inter-cylinder air/fuel ratio imbalance state has occurred, if travel distance of the vehicle from a time point of acquisition of the correction-purpose output value is greater than or equal to a threshold travel distance.

9. The inter-cylinder air/fuel ratio imbalance determination apparatus according to claim 7, wherein the engine is an engine mounted in a vehicle, and the imbalance determination device avoids executing calculation of the air/fuel ratio imbalance index value, if travel distance of the vehicle from a time point of acquisition of the correction-purpose output value is greater than or equal to a threshold travel distance.

10. The inter-cylinder air/fuel ratio imbalance determination apparatus according to claim 1, wherein the engine is an engine mounted in a vehicle, and the imbalance determination device avoids executing determination as to whether or not the inter-cylinder air/fuel ratio imbalance state has occurred, if travel distance of the vehicle from a time point of acquisition of the correction-purpose output value is greater than or equal to a threshold travel distance.

11. The inter-cylinder air/fuel ratio imbalance determination apparatus according to claim 1, wherein the engine is an engine mounted in a vehicle, and the imbalance determination device does not execute calculation of the air/fuel ratio imbalance index value, if travel distance of the vehicle from a time point of acquisition of the correction-purpose output value is greater than or equal to a threshold travel distance.

12. The inter-cylinder air/fuel ratio imbalance determination apparatus according to claim 1, wherein the imbalance index value acquisition device acquires as a basic index quantity one of: a value that correlates with a time differential value [d(Vabyfs)/dt] of the output value [Vabyfs] of the air/fuel ratio sensor; a value that correlates with a time differential value [d(abyfs)/dt] of a detected air/fuel ratio [abyfs] that is expressed by the output value [Vabyfs] of the air/fuel ratio sensor; a value that correlates with a time second order differential value [$d^2$(Vabyfs)/$dt^2$t] of the output value [Vabyfs] of the air/fuel ratio sensor; a value that correlates with a time second order differential value [$d^2$(abyfs)/$dt^2$t] of the detected air/fuel ratio [abyfs] that is expressed by the output value [Vabyfs] of the air/fuel ratio sensor; a value that correlates with a difference between a maximum value and a minimum value of the output value [Vabyfs] of the air/fuel ratio sensor in a predetermined period; and a value that correlates with a difference between a maximum value and a minimum value of the detected air/fuel ratio [abyfs] expressed by the output value [Vabyfs] of the air/fuel ratio sensor in a predetermined period, and acquires the air/fuel ratio fluctuation index quantity based on the basic index quantity acquired.

13. The inter-cylinder air/fuel ratio imbalance determination apparatus according to claim 1, wherein the imbalance index value acquisition device acquires as a basic index quantity one of a value that correlates with a locus length of the output value [Vabyfs] of the air/fuel ratio sensor in a predetermined period and a value that correlates with the locus length of a detected air/fuel ratio [abyfs] expressed by the output value of the air/fuel ratio sensor in a predetermined period, and acquires the air/fuel ratio fluctuation index quantity based on the basic index quantity acquired.

14. An inter-cylinder air/fuel ratio imbalance determination method of determining presence or absence of an inter-cylinder air/fuel ratio imbalance in an inter-cylinder air/fuel ratio imbalance determination apparatus that has: a limiting current type air/fuel ratio sensor that is disposed in an exhaust confluence portion of an exhaust passageway of a multi-cylinder internal combustion engine in which flows of exhaust gas from a plurality of cylinders of the engine meet, or is disposed downstream of the exhaust confluence portion; and a plurality of fuel injection valves that inject a fuel that is contained in a mixture supplied into a combustion chamber of each of the cylinders, the method comprising:

sending out an injection command signal to the fuel injection valves so that each of the fuel injection valves injects an amount of the fuel that is commensurate with a predetermined commanded fuel injection amount;

executing a fuel-cut operation by stopping fuel injection performed by the fuel injection valves when a predetermined fuel-cut condition is satisfied;

acquiring an air/fuel ratio imbalance index value that increases with increase in degree of non-uniformity between the cylinders in a cylinder-by-cylinder air/fuel ratio that is an air/fuel ratio of the mixture supplied into the combustion chamber of each of the cylinders;

determining whether or not the inter-cylinder air/fuel ratio imbalance state has occurred, based on a result of comparison between the air/fuel ratio imbalance index value acquired and a predetermined imbalance determination threshold value, wherein in the step of acquiring the air/fuel ratio imbalance index value acquisition, a correction-purpose output value that increases with increase in output value of the air/fuel ratio sensor during a period of execution of the fuel-cut operation is acquired, and an air/fuel ratio fluctuation index quantity that increases with increase in fluctuation of the output value of the air/fuel ratio sensor and that decreases with increase in the correction-purpose output value is acquired as the air/fuel ratio imbalance index value, based on the output value of the air/fuel ratio sensor and the correction-purpose output value.

* * * * *